US012258755B2

(12) United States Patent
Gernhart et al.

(10) Patent No.: US 12,258,755 B2
(45) Date of Patent: Mar. 25, 2025

(54) SOUND ISOLATION ASSEMBLIES FOR WALLS SUPPORTING HEAVY LOADS

(71) Applicant: MTEC, LLC, Las Vegas, NV (US)

(72) Inventors: Michael Ray Gernhart, Aurora, OR (US); Dalton Michael Jeffery Gernhart, Aurora, OR (US); Elzo Forrest Gernhart, Las Vegas, NV (US)

(73) Assignee: MTEC, LLC, Las Vegas, NV (US)

( * ) Notice: Subject to any disclaimer, the term of this patent is extended or adjusted under 35 U.S.C. 154(b) by 630 days.

(21) Appl. No.: 17/407,873

(22) Filed: Aug. 20, 2021

(65) Prior Publication Data

US 2023/0058019 A1 Feb. 23, 2023

(51) Int. Cl.

| | |
|---|---|
| ***E04B 2/74*** | (2006.01) |
| ***E04B 1/82*** | (2006.01) |
| ***E04B 1/84*** | (2006.01) |
| ***E04B 1/98*** | (2006.01) |
| ***F16F 1/38*** | (2006.01) |
| ***F16F 15/02*** | (2006.01) |

(Continued)

(52) U.S. Cl.

CPC .... *E04B 2/7412* (2013.01); *E04B 2001/8272* (2013.01)

(58) Field of Classification Search

CPC . E04B 1/8209; E04B 1/38; E04B 1/84; E04B 1/98; E04B 2001/8254; E04B 2001/8263; E04B 2001/8272; E04B 2/7412; E04B 2002/7485; E04B 2002/7483; E04B 2002/7461; E04B 2002/7462; F16F 1/3732; F16F 1/373; F16F 1/3849; F16F 1/3842; F16F 1/38; F16F 15/08; F16F 15/04; F16F 15/02

See application file for complete search history.

(56) References Cited

U.S. PATENT DOCUMENTS 3,381,636 A * 5/1968 Saiberlich ..... A47B 57/46 108/42
3,951,228 A * 4/1976 Schnell ..... G10K 11/16 181/200

(Continued)

FOREIGN PATENT DOCUMENTS

CN 203613553 U * 5/2014
CN 203947625 U * 11/2014

(Continued)

OTHER PUBLICATIONS

JP-2011174327-A (Year: 2011).*

*Primary Examiner* — Edgardo San Martin

(74) *Attorney, Agent, or Firm* — Kevin Schraven; Anooj Patel; Hankin Patent Law, APC

(57) ABSTRACT

A sound isolation assembly comprising: one or more backing plates; one or more acoustic isolators; and a backing block. The acoustic isolators may be secured between the backing plates and the backing block when the backing plates are fastened to the backing block. When the backing plates are fastened to the backing block, the backing plates are substantially prevented by the acoustic isolators from being in direct contact with the backing block. The acoustic isolators may be fastened to the studs. The sound isolation assembly, when installed in a wall that is supporting a heavy load, raises the Sound Transmission Class rating of that wall.

11 Claims, 29 Drawing Sheets

(51) Int. Cl.
*F16F 15/04* (2006.01)
*F16F 15/08* (2006.01)

(56) References Cited

U.S. PATENT DOCUMENTS 4,074,491 A * 2/1978 Bell ..... F16B 37/041 411/116
4,457,436 A * 7/1984 Kelley ..... A47B 95/008 312/246
5,306,121 A * 4/1994 Heflin ..... F16F 15/08 417/363
5,392,934 A * 2/1995 Fox ..... A47F 5/0846 248/220.31
7,398,856 B2 * 7/2008 Foster ..... E04B 2/7457 181/290
7,647,744 B2 * 1/2010 Payne, Jr. ..... E04B 1/82 52/355
8,662,247 B1 * 3/2014 Swist ..... F16F 15/08 181/207
9,045,898 B2 * 6/2015 Ravnaas ..... E04B 2/7409
9,051,730 B2 * 6/2015 Gates ..... E04B 1/84
9,163,415 B2 * 10/2015 Nies ..... A47B 57/52
10,968,626 B2 * 4/2021 Stevens ..... E04B 1/4178
11,058,222 B2 * 7/2021 Farjamrad ..... A47B 96/067
2003/0192279 A1 * 10/2003 Hughart ..... E04B 2/7457 181/290
2006/0179760 A1 * 8/2006 Burg ..... E04B 2/7457 52/479
2015/0275511 A1 * 10/2015 Hammer ..... E04B 2/7409 52/749.1

FOREIGN PATENT DOCUMENTS

CN 206572734 U * 10/2017
JP 2011174327 A * 9/2011
JP 2015034383 A * 2/2015
JP 2018059379 A * 4/2018
KR 20200045421 A * 5/2020
KR 20220146721 A * 11/2022
KR 20230039804 A * 3/2023
KR 20230171516 A * 12/2023
WO WO-2019106116 A1 * 6/2019 ..... E04B 1/82
WO WO-2020209775 A1 * 10/2020 ..... E04B 1/98

* cited by examiner

SOUND ISOLATION ASSEMBLIES FOR WALLS SUPPORTING HEAVY LOADS

FIELD OF USE

The present disclosure relates generally to devices, methods, and systems for sound isolation assemblies, and more specifically relates to acoustically isolated supports for heavy loads on resiliently isolated wall assemblies in the building construction industry.

BACKGROUND

Approximately sixty (60) years ago the construction industry started using acoustical isolation systems based on resilient channels. In that time, there has been no cost effective and sound dampening system that allows the mounting of heavy loads, such as cabinets, shelves, handrails, grab bars, headboards, bed side stands, flat screen tv, wall mounted desks, and wall mounted furniture, without compromising the acoustical performance of the wall acoustical isolation system. Thus, sound transmission through the wall at the point where a heavy load is attached to the wall is greater than at other portions of the wall.

Thus, what is needed is cost effective acoustical isolation system for walls that have heavy loads attached to them.

SUMMARY

To minimize the limitations in the art, and to minimize other limitations that will become apparent upon reading and understanding the present specification, the present specification discloses devices, methods, and systems for providing acoustically isolated support for heavy loads on a resiliently isolated wall assembly.

The devices, methods, and systems of the present disclosure may comprise an acoustically isolated system for cabinets, shelves, handrails, grab bars, headboards, bed side stands, flat screen TV, wall mounted desks, and wall mounted furniture that are mounted on to resiliently isolated walls. The acoustic isolated support devices, methods, and systems provide the acoustical isolation needed to comply with current building code minimum standards.

The acoustic isolated support devices, methods, and systems of the present disclosure provides several different ways to attach various fixtures to an acoustically rated resiliently isolated wall assembly without compromising the Sound Transmission Classification (STC) of the wall assembly.

Acoustical Sound Transmission Class (STC) testing was conducted by an independent third-party acoustical testing laboratory that was Accredited and Certificated to conduct ASTM (American Society for Testing and Materials) E90 testing. The test results, presented herein, show that the STC of walls, when furniture or other heavy loads are attached, is compromised. The test results also show that the devices, systems, and methods of the present disclosure reduce or element the negative effects caused by mounted furniture and fixtures.

The devices, systems, and methods of the present disclosure may be used with, but are not limited to use with, wall systems with finish panels, such as gypsum boards, timber framed walls, and/or walls with steel studs.

One embodiment may be devices, methods, and systems for isolating focused or distributed loads on a resiliently decoupled wall system with finish panels, such as gypsum boards. The sound isolation system may preferably comprise: one or more backing plates (or brackets), one or more acoustic isolators, and a backing block. The backing plates may comprise a bent metal, such as steel, bracket that has screw holes. In some embodiments the backing plates are a lazy "Z" shape and are configured to be securely fastened to the wall studs and the backing block. The shape, bends, strength and thickness of the backing plates varies depending on what the load is and of what materials the studs and backing block are made. The acoustical isolators may preferably be natural rubber, synthetic rubber, plastic, or a viscoelastic compound. The system is preferably connected together by screws or bolts, but any mechanical or chemical connection mechanism may be used. The backing block may be made from any material that can handle the load, including, but not limited to, wood, plywood, oriented strand board, steel, aluminum, concrete, rock, composites, fiberglass, rock, and/or sheet rock.

One embodiment may be a sound isolation assembly comprising: one or more backing plates; one or more acoustic isolators; and a backing block; wherein the one or more acoustic isolators are configured to be secured between the one or more backing plates and the backing block when the one or more backing plates are fastened to the backing block; wherein when the one or more backing plates are fastened to the backing block, the one or more backing plates are substantially prevented by the one or more acoustic isolators from being in direct contact with the backing block; and wherein the one or more acoustic isolators are configured to be fastened to the one or more studs. The one or more studs are configured to be fastened to a resilient channel; and wherein the resilient channel protrudes away from the one or more studs at a same distance as the backing block. The backing block may be made from a material from the group of materials consisting of one or more of: solid wood; plywood; oriented strand board; metal; and combinations thereof. The one or more studs may be made from a material from the group of materials consisting of one or more of: solid wood; plywood; oriented strand board; metal; and combinations thereof. The one or more backing plates may be flat, L-shaped, and/or lazy Z-shaped. The backing block may be configured to be fastened to and support loads in excess of twenty pounds in weight. When the sound isolation assembly is installed in a wall that is supporting a heavy load, the sound isolation assembly raises the Sound Transmission Class rating of the wall.

Another embodiment may be a sound isolation assembly comprising: one or more backing plates; one or more acoustic isolators; and a backing block; wherein the one or more acoustic isolators are configured to be secured between the one or more backing plates and the backing block when the one or more backing plates are fastened to the backing block; wherein when the one or more backing plates are fastened to the backing block, the one or more backing plates are substantially prevented by the one or more acoustic isolators from being in direct contact with the backing block; wherein the one or more acoustic isolators are configured to be fastened to the one or more studs; wherein the one or more studs are configured to be fastened to a resilient channel; wherein the resilient channel protrudes away from the one or more studs at a same distance as the backing block; and wherein when the sound isolation assembly is installed in a wall that is supporting a heavy load, the sound isolation assembly raises the Sound Transmission Class rating of the wall.

Another embodiment of the sound isolation assembly may comprise: one or more backing plates; one or more acoustic isolators; and a backing block; wherein the one or more acoustic isolators are configured to be secured between the one or more backing plates and the backing block when the one or more backing plates are fastened to the backing block; wherein when the one or more backing plates are fastened to the backing block, the one or more backing plates are substantially prevented by the one or more acoustic isolators from being in direct contact with the backing block; wherein the one or more acoustic isolators are configured to be fastened to the one or more studs; wherein the one or more studs are configured to be fastened to a resilient channel; wherein the resilient channel protrudes away from the one or more studs at a same distance as the backing block; wherein when the sound isolation assembly is installed in a wall that is supporting a heavy load, the sound isolation assembly raises the Sound Transmission Class rating of the wall; wherein the backing block is made from a material from the group of materials consisting of one or more of: solid wood; plywood; oriented strand board; metal; and combinations thereof; and wherein the backing block is configured to be fastened to and support loads in excess of twenty pounds in weight.

Other features and advantages will become apparent to those skilled in the art from the following detailed description and its accompanying drawings.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps which are illustrated. When the same numeral appears in different drawings, it refers to the same or like components or steps.

DETAILED DESCRIPTION OF THE ILLUSTRATED EMBODIMENTS

Figure 1:
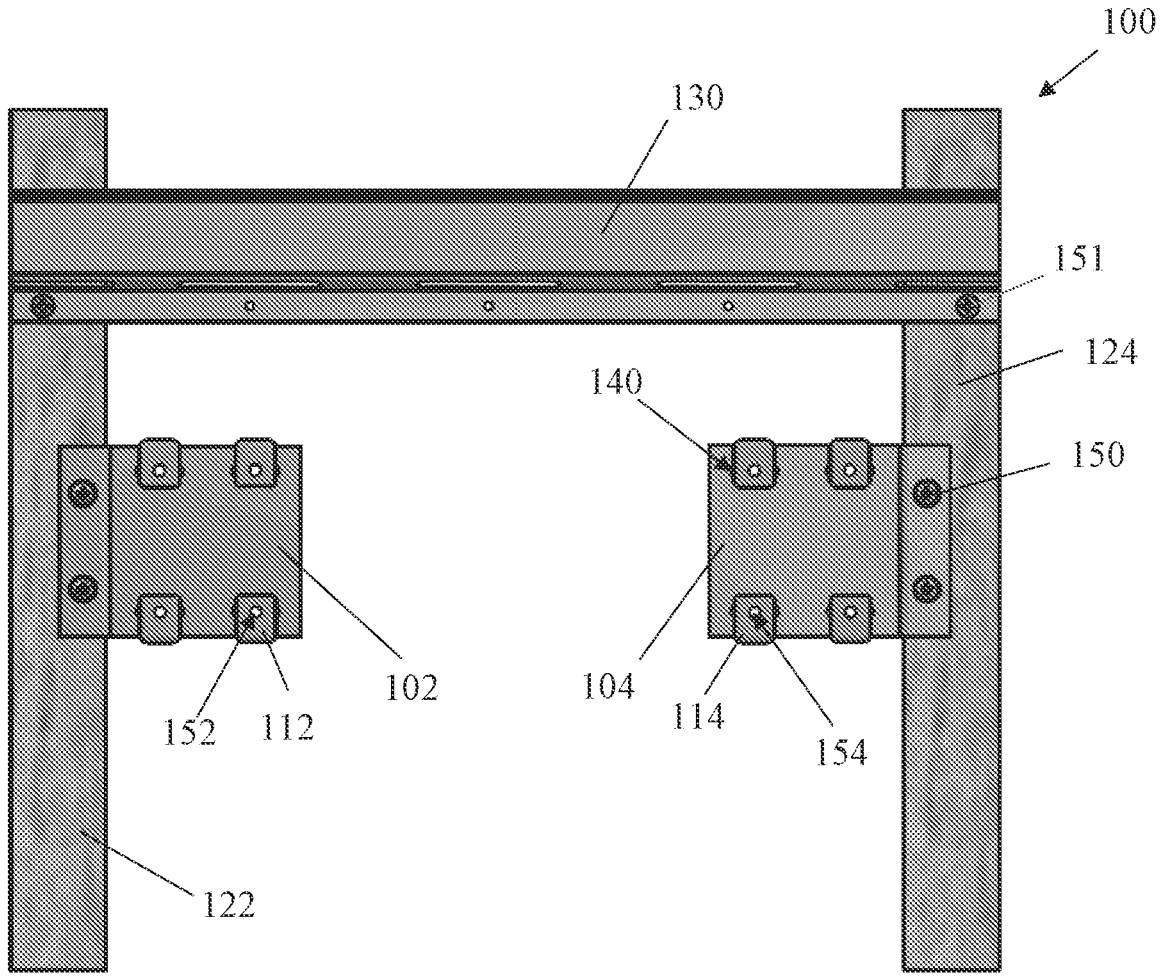
FIG. 1 is an illustration of a front view of one embodiment of a sound isolation assembly.

In the following detailed description of various embodiments, numerous specific details are set forth in order to provide a thorough understanding of various aspects of the embodiments. However, the embodiments may be practiced without some or all of these specific details. In other instances, well-known procedures and/or components have not been described in detail so as not to unnecessarily obscure aspects of the embodiments.

While some embodiments are disclosed here, other embodiments will become obvious to those skilled in the art as a result of the following detailed description. These embodiments are capable of modifications of various obvious aspects, all without departing from the spirit and scope of protection. The Figures, and their detailed descriptions, are to be regarded as illustrative in nature and not restrictive. Also, the reference or non-reference to a particular embodiment shall not be interpreted to limit the scope of protection.

In the following description, certain terminology is used to describe certain features of one or more embodiments. For purposes of the specification, unless otherwise specified, the term "substantially" refers to the complete or nearly complete extent or degree of an action, characteristic, property, state, structure, item, group of items, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking, the nearness of completion will be so as to have the same overall result as if absolute and total completion were obtained. The use of "substantially" is also equally applicable when used in a negative connotation to refer to the complete or near complete lack of an action, characteristic, property, state, structure, item, group of items, or result. In another example, substantially all of a group of items, may include all of the items of that group, or at least all of the items of that group that are generally within the normal parameters for the items. To the extent that the group of items might include members that far exceed the normal parameters, this abnormal item might not be expected to be part of substantially all the group of items.

As used herein, the terms "approximately" and "about" generally refer to a deviance of within 5% of the indicated number or range of numbers. In one embodiment, the term "approximately" and "about", may refer to a deviance of between 0.0001-25% from the indicated number or range of numbers.

For purposes of this disclosure, the term "heavy load" refers to an object or load that weighs more than 19.9 pounds.

For purposes of this disclosure, the term "stud" and "studs" refers to a framing member in a building's wall, floor, or ceiling. When the stud is a wall stud, it is typically a vertical framing member that has a smaller cross section than the wall post or end framing member. Studs are typically solid wood, steel, or another metal. When metal, they are typically hollow to reduce their weight.

For purposes of this disclosure, the term "resilient channel" refers to a metal channel shaped device that is configured to be placed at right angles to the studs. The drywall is then screwed into the channel. In this way, the resilient channel isolates the drywall from the studs, thus carrying less noise and vibration to the outer wall.

For purposes of this disclosure, the term "fastened", "secured", and "connected" refers to the act of joining devices and assemblies together via mechanical, chemical, and electrochemical mechanisms. The joining may be permanent, temporary, or reversable. Examples of fastening, securing, and connecting devices includes, but is not limited to: screws, nails, fasteners, clasps, snaps, friction, springs, bolts, adhesives, solder, welding, and/or ultrasonic welding.

The drawings show illustrative embodiments, but do not depict all embodiments. Other embodiments may be used in addition to or instead of the illustrative embodiments. Details that may be apparent or unnecessary may be omitted for the purpose of saving space or for more effective illustrations. Some embodiments may be practiced with additional components or steps and/or without some or all components or steps provided in the illustrations. When different drawings contain the same numeral, that numeral refers to the same or similar components or steps.

One embodiment may be devices, methods, and systems for isolating focused or distributed loads on a resiliently decoupled wall system with finish panels or backing blocks, such as wood or gypsum boards. The sound isolation system may comprise: one or more backing plates (or brackets), one or more acoustic isolators, and a backing block. The backing plates may be a single lazy "Z" shape or a saddle double lazy "Z" shape. Variables include depth, projection or offset varies dependent upon the type and size (thickness) of the backing plate or block required by the walls resilient isolation channels or resilient isolation system. The acoustic isolators may preferably be a natural or synthetic rubber, plastic, or viscoelastic compound. Preferably, the acoustic isolator is mounted to the backing plates by screws, but any connection mechanism or compound may be used, such as a bolt and/or adhesive. The backing block may preferably be solid timber, wood, plywood, oriented strand board (OSB), steel, aluminum, or fiberglass, and the thickness and strength of the backing block may vary dependent upon the span, static, or dynamic loads imposed upon the System. The backing plates may be connected to the studs and the backing block via screws, bolts, and the like.

FIG. 1 is an illustration of a front view of one embodiment of a sound isolation assembly. As shown in FIG. 1, the assembly 100 may comprise one or more backing plates 102, 104, one or more acoustic isolators 112, 114, and a backing block 200 (shown in FIG. 2). The backing plates 102, 104 are preferably configured to securely engage with and/or fasten to the acoustic isolators 112, 114 and studs 122, 124. In one embodiment, screws 150 are used to secure the backing plates 102, 104 to the studs 122, 124. The backing plates 102, 104 may preferably be made of a hard and rigid material, such as steel. The acoustic isolators 112, 114 may be made from a viscoelastic material, such as natural or synthetic rubber, which provides for excellent sound and vibration dampening. The backing block 200 is preferably indirectly connected to or engaged with the backing plates 102, 104, with the acoustic isolators 112, 114 being sandwiched in between, and being in direct contact with, the backing block 200 and backing plates 102, 104. This provides for the acoustical isolation of the backing block 200 and any loads attached to the backing block 200. FIG. 1 shows that the studs 122, 124 may be standard timber wall studs. FIG. 1 shows that the studs 122, 124 may also engage with a standard resilient channel 130 acoustical isolation device. In one embodiment screws 151 are used to secure the resilient channel 130 to the studs 122, 124.

FIG. 1 shows that the backing plates 102, 104 may be fastened to the studs 122, 124 via screws. But, any fastening mechanism, mechanical (such as a bolt) and/or chemical (such as an adhesive) may be used. FIG. 1 shows that the acoustic isolators 112, 114 may be secured to the backing plates 102, 104 via a bolt or a screw, but any fastening mechanism may be used. FIG. 1 shows that multiple acoustic isolators 112, 114, in this case four (4) acoustic isolators, may be attached to each backing plate 102, 104. In one embodiment the backing plates 102, 104 have slots 140 where the acoustic isolators 112, 114 engage with the backing plates 102, 104. This allows the acoustic isolators 112, 114 to be adjustable along the slots 140.

Figure 2:
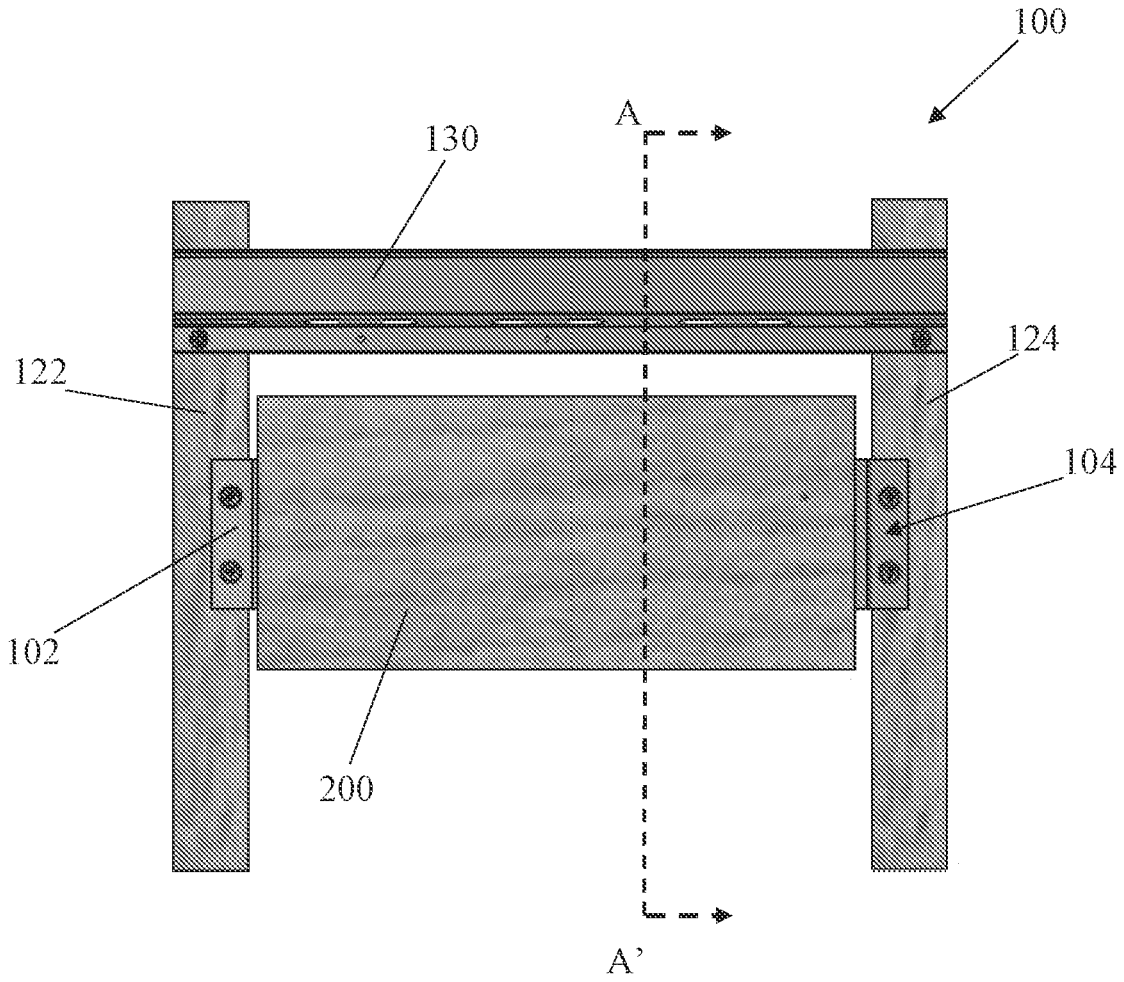
FIG. 2 is an illustration of a front view of one embodiment of a sound isolation assembly with a backing block.

FIG. 1 shows that the acoustic isolators 112, 114 may have a hole 152, 154 that aligns with the slots 140. In this manner, a screw, or other connection mechanism, may be threaded through the holes 152, 154, and slots 140, such that the acoustic isolators 112, 114 and backing plates 102, 104 may be securely engaged to the backing block 200. Although only slot 140 is labeled in FIG. 1, as shown, each backing plate 102, 104 preferably has four slots, one for each acoustic isolator. FIG. 1 also shows that each isolator preferably has a hole that is configured to align and overlap FIG. 2 is an illustration of a front view of one embodiment of a sound isolation assembly with a backing block. As shown in FIG. 2, the backing block 200 may securely engage with backing plates 102, 104 (via the acoustic isolators 112, 114. The backing block 200, which is preferably made from a sturdy material, such as solid wood, plywood, OSB, steel, sheet rock, rock, gypsum board, and the like. In this manner, the backing block 200 is acoustically isolated relative to the studs 122, 124, and is capable of supporting heavy loads hanging from it or connected to it, such as bookshelves, shelves, desk, other types of furniture, artwork, and the like.

Figure 3:
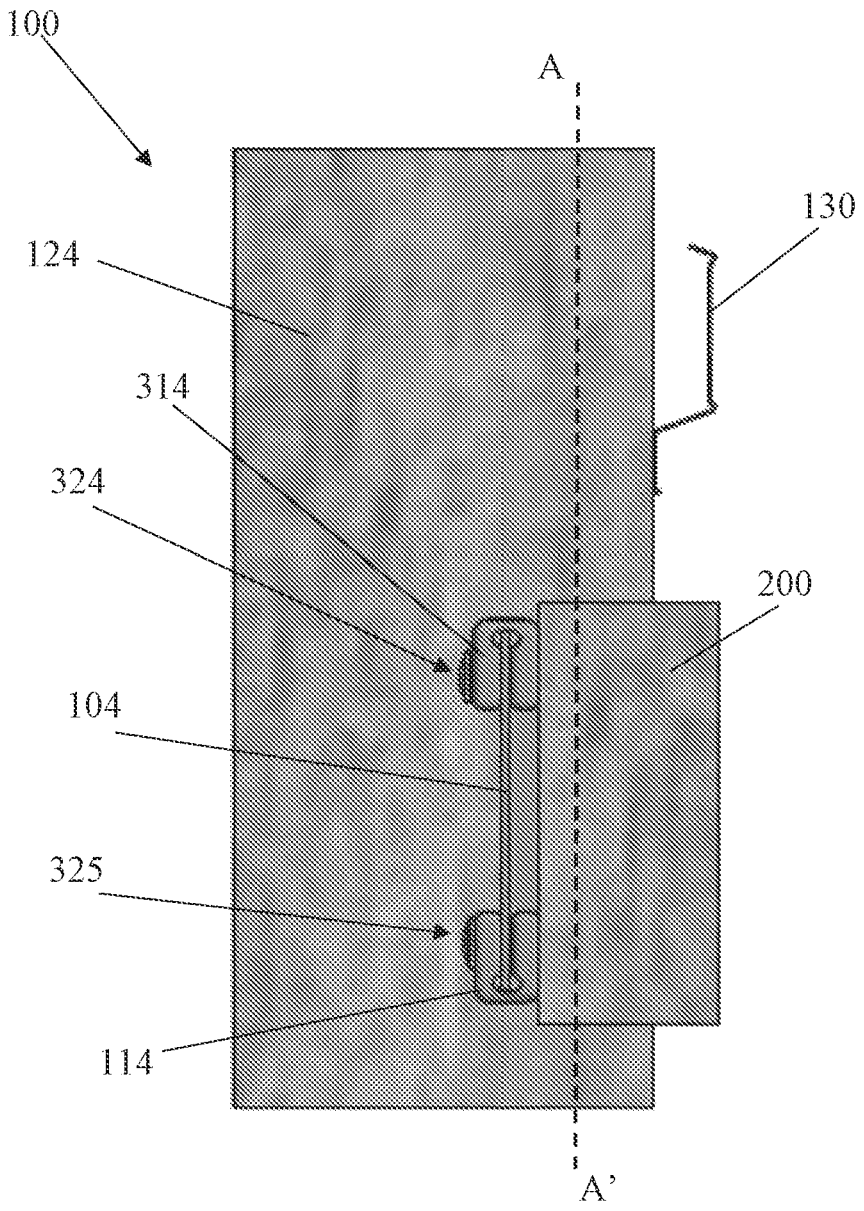
FIG. 3 is a cross-section view of one embodiment of a sound isolation assembly.

FIG. 3 is a cross-section view of one embodiment of a sound isolation assembly. As shown in FIG. 3, the assembly 100 may comprise backing plate 104, acoustic isolators 114, 314, and backing block 200. The acoustic isolators 114, 314 are preferably U-shaped, as shown, but they may be substantially any shape so long as they fit between the backing plate 104 and the backing block 200. The U-shape is preferred because it allows a single acoustic isolator 114, 314 to buffer not only between the backing plate and the backing block, but also between the head of the screws 324, 325 (and washer, if any) and the backing plate 104, such screws 324, 325 that are securing the isolator 114, 314 and the backing plate 104 to the backing block 200. Although the isolator 114, 314, backing plate 104, and backing block 200 are preferably secured by screws 324, 325, any fastening mechanism may be used, including nails, bolts, rivets, adhesives, and the like.

FIG. 3 also shows how the backing plate 104 is bent so that it is off set from the stud 124 at the point where the backing plate 104 engages with the backing block 200. In this manner, the outer surfaces of the backing block 200 and the resilient channel 130 outwardly protrude an approximate distance, such that they can engage in a planar manner the inner surface of the gypsum board that makes up the outer portion of the wall.

Figure 4:
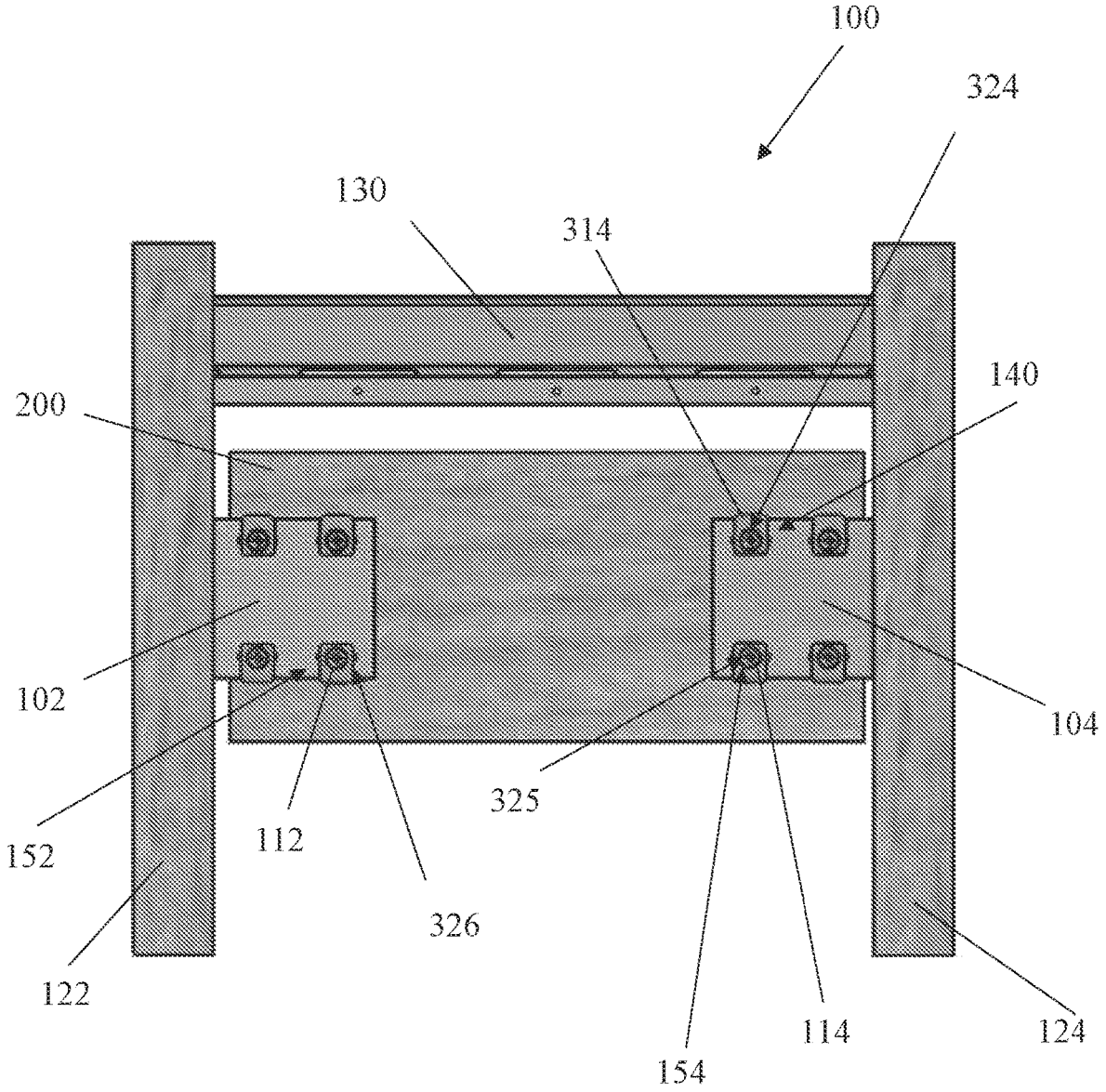
FIG. 4 is a rear view of one embodiment of a sound isolation assembly.

FIG. 4 is a rear view of one embodiment of a sound isolation assembly. As shown in FIG. 4, the assembly 100 may comprise backing plates 102, 104, acoustic isolators 112, 114, 314, and backing block 200. FIG. 4 also shows that screws 324, 325, 326 pass through holes 152, 154 and slots 140 to securely fasten the isolators 112, 114, 314 and the backing plates 102, 104 to the backing block 200.

Figure 5:
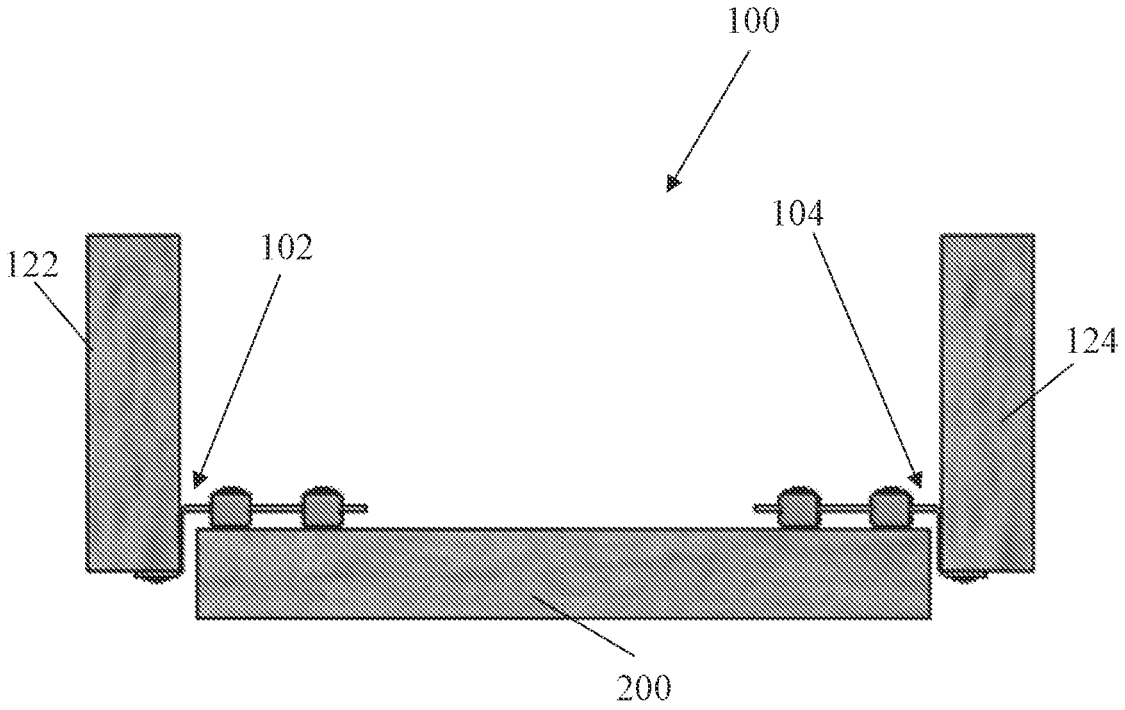
FIG. 5 is a bottom view of one embodiment of a sound isolation assembly.

FIG. 5 is a bottom view of one embodiment of a sound isolation assembly. FIG. 5 shows that the backing plates 102, 104 of assembly 100 may have a lazy "Z" shape, such that the backing block 200 is inset with respect to the studs 122, 124. In this view, the resilient channel 130 is not shown.

Figure 6:
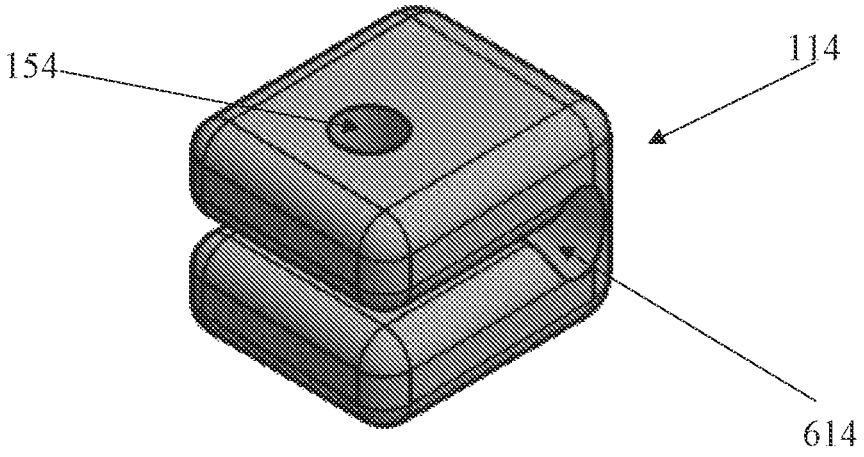
FIG. 6 is a perspective view of one embodiment of an acoustic isolator.

FIG. 6 is a perspective view of one embodiment of an acoustic isolator. As shown in FIG. 6, the acoustic isolator 114 may have a hole 154 and a slot 614. The slot 614 is configured to allow the acoustic isolator 114 to matingly engage with a backing plate. The hole 154 is configured to allow a connector or fastener, such as a bolt, nail, or screw to pass through. Although acoustic isolator 114 has a square, cube, and U-shape with rounded edges, the acoustic isolator may substantially be any shape so long as the backing block is acoustically isolated by the acoustic isolators from the backing plates and the studs.

Figure 7:
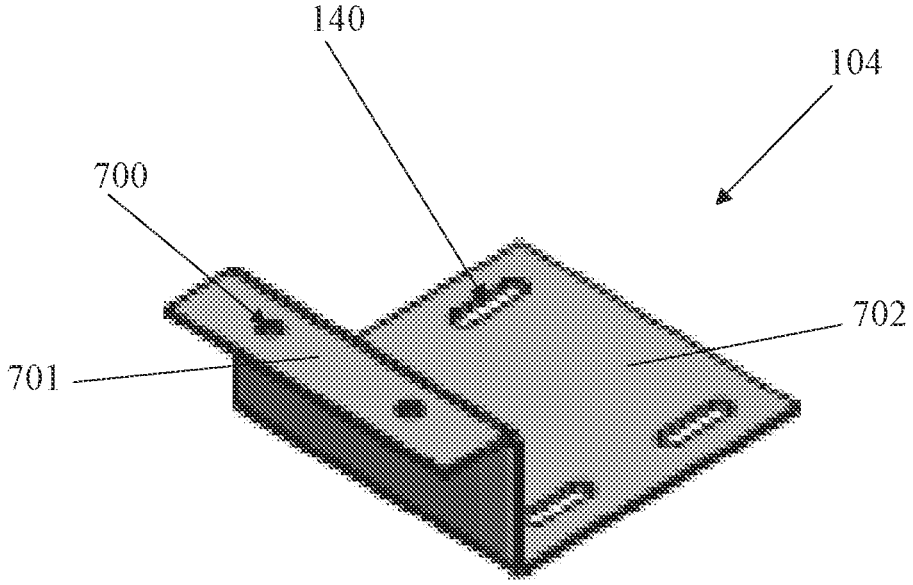
FIG. 7 is a perspective view of one embodiment of a backing plate.

FIG. 7 is a perspective view of one embodiment of a backing plate. As shown in FIG. 7 backing plate 104 may be a lazy Z-shape with slots 140, stud screw holes 700, stud engagement portion 701, and backing block adjacent portion 702. Although a lazy Z-shape is shown, the backing plate 104 may be any shape, including flat, offset, trapezoidal, wavy, and the like. The backing plate 104 may preferably be used for loads that are 100 to 200 pounds per backing plate used.

Acoustical Testing

The test results discussed below were all done with the same procedures and calculations.

Regarding the testing procedure, the sensitivity of the microphones was checked before measurements were conducted. The transmission loss values were obtained for a single direction of measurement. Two background noise sound pressure level and five sound absorption measurements were conducted at each of five microphone positions. The air temperature and relative humidity conditions were monitored and recorded during all measurements.

Regarding the acoustical test calculations, Transmission Loss (TL) at each ⅓ octave frequency is the average source room sound pressure level minus the average receive room sound pressure level, plus, ten (10) times the log of the specimen area divided by the sound absorption of the receive room with the sample in place. To obtain the Sound Transmission Class (STC), take the TL of the contour curve at 500 Hz. The sum of the deficiencies that are below the contour curve must not exceed 32. The maximum deficiency at any one frequency must not exceed 8. The Outdoor-Indoor Transmission Class (OITC) is calculated by subtracting the logarithmic summation of the TL values from the logarithmic summation of the A-weighted transportation noise spectrum provided in ASTM E1332.

Figure 8:
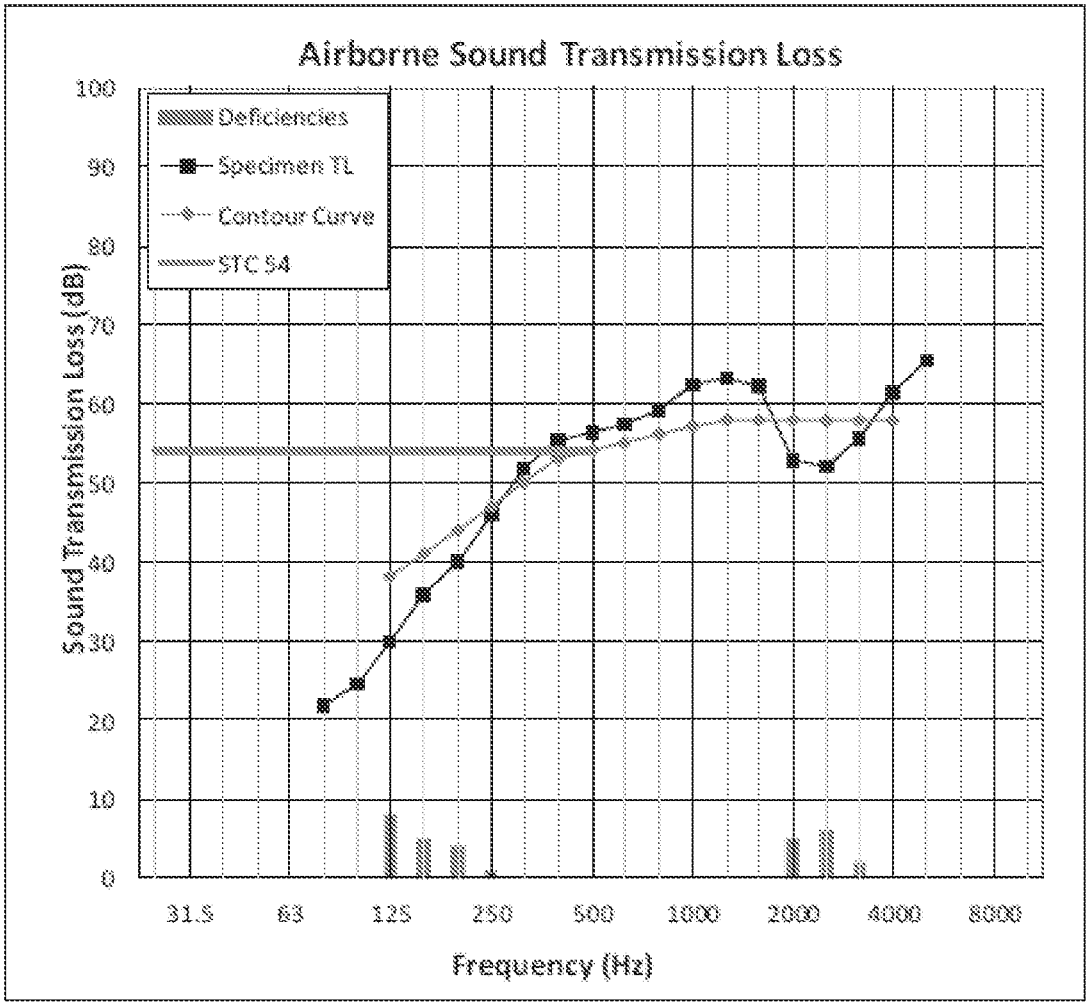
FIG. 8 is a graph of the results of an acoustical test on a control wall.

FIG. 8 is a graph of the results of an acoustical test on a control wall. Specifically, FIG. 8 shows the acoustical test results for a typical timber framed wall using timber studs 1.5" (38 mm)×3.5" (88 mm) spaced at 16-inch center, with 1.5" (38 mm)×3.5" (88 mm) top and bottom plates, fiberglass insulation 3.5 inch unfaced in the stud cavity, two (2) layers of gypsum board directly screwed to the timber framing with drywall screws. On the opposite side resilient channels are installed spaced at 24" on center and screwed to every stud spaced at 16" on center. One (1) layer of gypsum board screw attached to the resilient channels. The test results shown in FIG. 8 are Sound Transmission Class (STC) 54.

Figure 9:
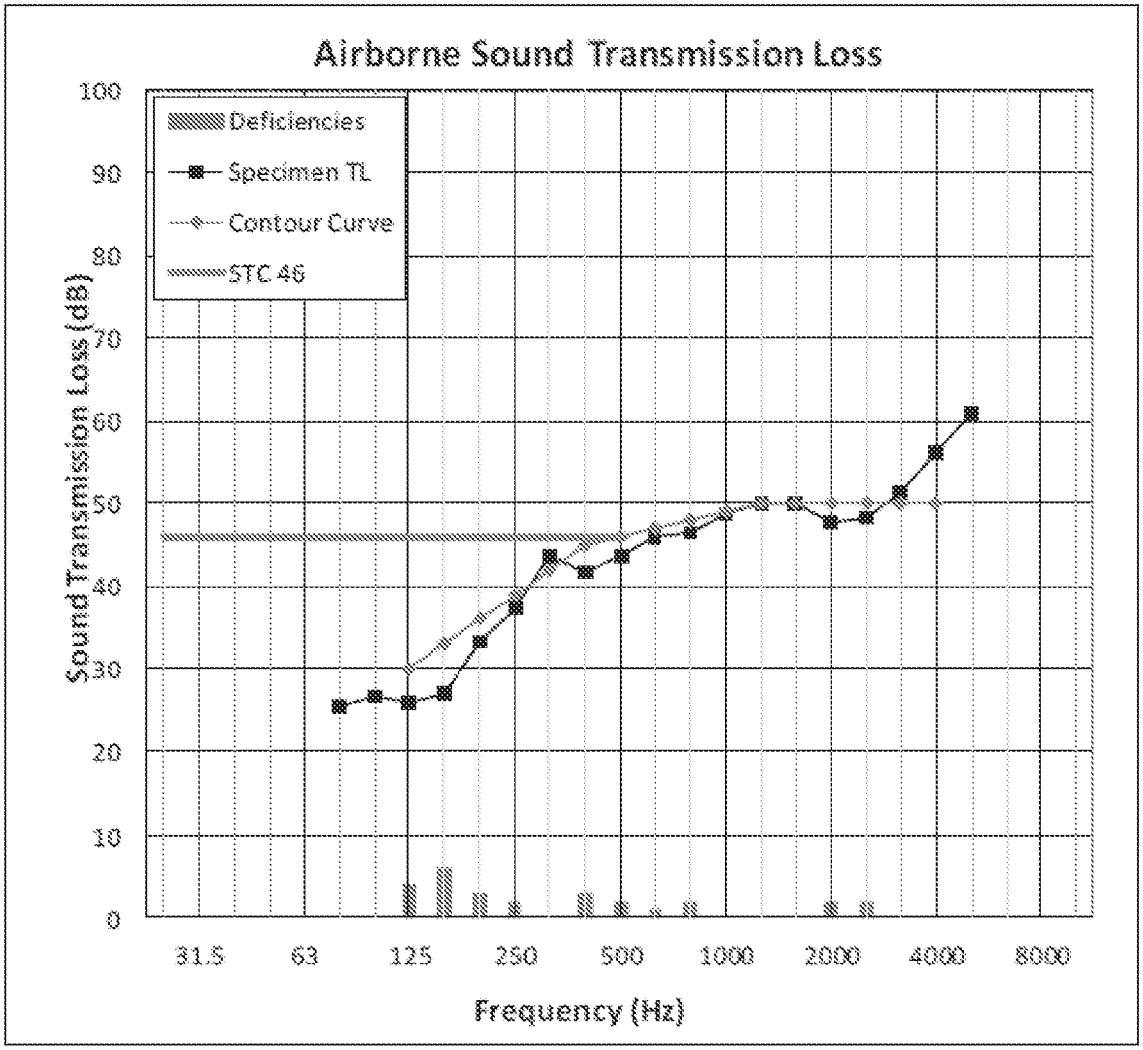
FIG. 9 is a graph of the results of an acoustical test on a control wall with a backing block and a heavy load attached thereto.

FIG. 9 is a graph of the results of an acoustical test on a control wall with a backing block and a heavy load attached thereto. Specifically, FIG. 9 shows the acoustical test results for a typical timber framed wall using timber studs 1.5" (38 mm)×3.5" (88 mm) spaced at 16-inch center, with 1.5" (38 mm)×3.5" (88 mm) top and bottom plates, fiberglass insulation 3.5 inch unfaced in the stud cavity, two (2) layers of gypsum board directly screwed to the timber framing with drywall screws. On the opposite side resilient channels are installed spaced at 24" on center and screwed to every stud spaced at 16" O.C. Between the resilient channels a 12-inch-wide×72-inch-long section of nominal ½" plywood is screwed to each stud the plywood strip intersected to serve as a filler (backing block) piece to support the load (such as cabinets) to be installed. One (1) layer of gypsum board screw attached to the resilient channels. Attached to the test wall above was three (3) each 24-inch-wide×36-inch-tall upper cabinets mounted side by side and screwed into the nominal ½ inch plywood only. The plywood backing block supports the weight of the cabinets, which would be too heavy to merely hang on the gypsum.

The test results show that there is an STC 46, which is a full eight (8) point reduction in the STC rating. In other words, based upon a human ears' perception of the noise, the noise coming through the wall doubled.

The test report below shows an STC 47, which is a full seven (7) point reduction in the STC rating. In other words, based upon a human ears' perception of the noise, the noise coming through the wall still doubled even with the addition of the '192 sound isolation assembly.

Figure 10:
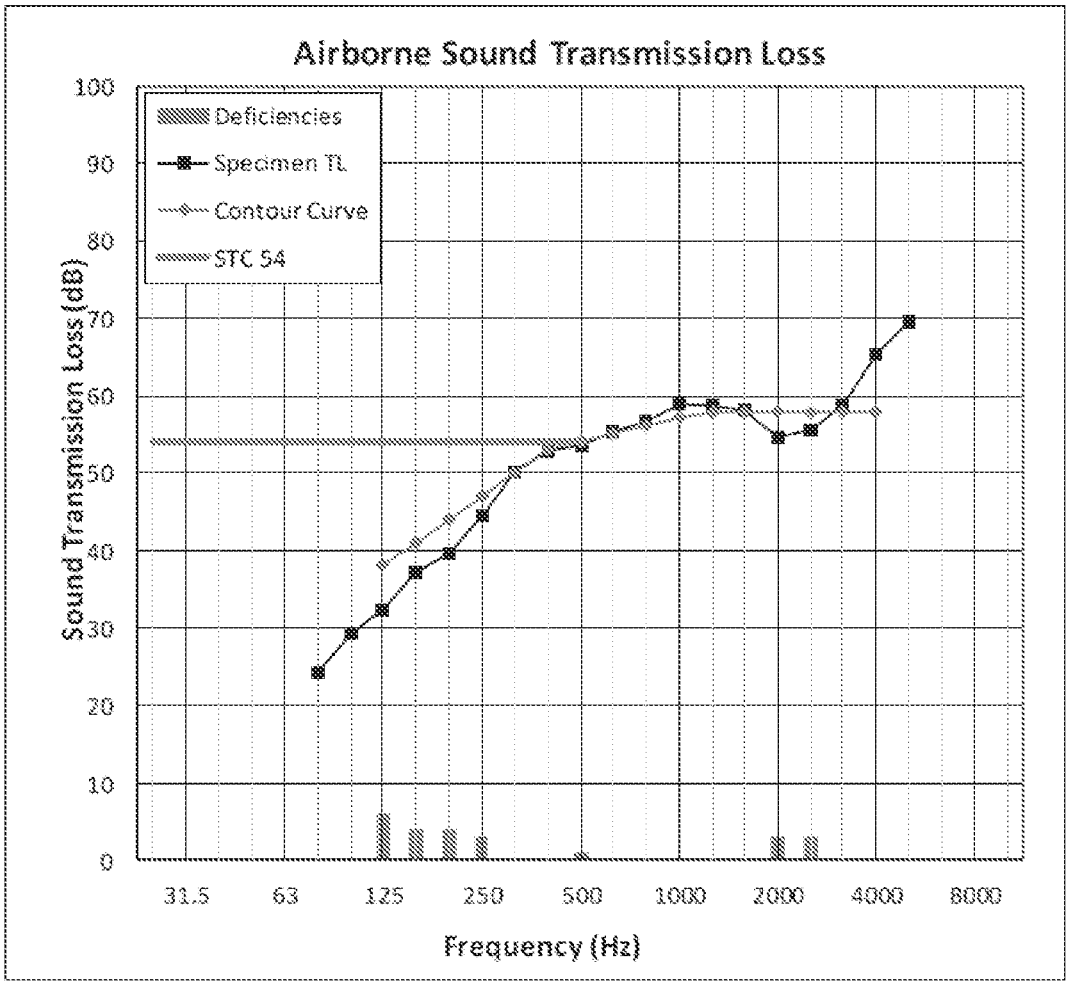
FIG. 10 is a graph of the results of an acoustical test on a wall in use with the sound isolation assembly 100 with a heavy load attached to the backing block of the sound isolation assembly 100.

FIG. 10 is a graph of the results of an acoustical test on a wall in use with the sound isolation assembly 100 with a heavy load attached to the backing block of the sound isolation assembly 100. The wall for the results shown in FIG. 10, is the same wall of FIG. 8, but with the sound isolation assembly 100 integrated into the wall. This wall, which includes acoustical isolated (decoupled) backing system for resiliently isolated wall and cabinets installed, achieved an STC 54. This means the sound isolation assembly 100 restored the wall to the original baseline wall test results (STC 54), shown in FIG. 8.

The series of test results proves that a resiliently isolated wall using a conventional installation and a plywood backing block for use with heavy loads, compromises the acoustical performance of the wall to be below the International Building Code (IBC) minimum requirement of STC 50. The sound isolation assembly of the present disclosure restores the STC to be above the STC 50 required.

Additional Embodiments

Figure 11:
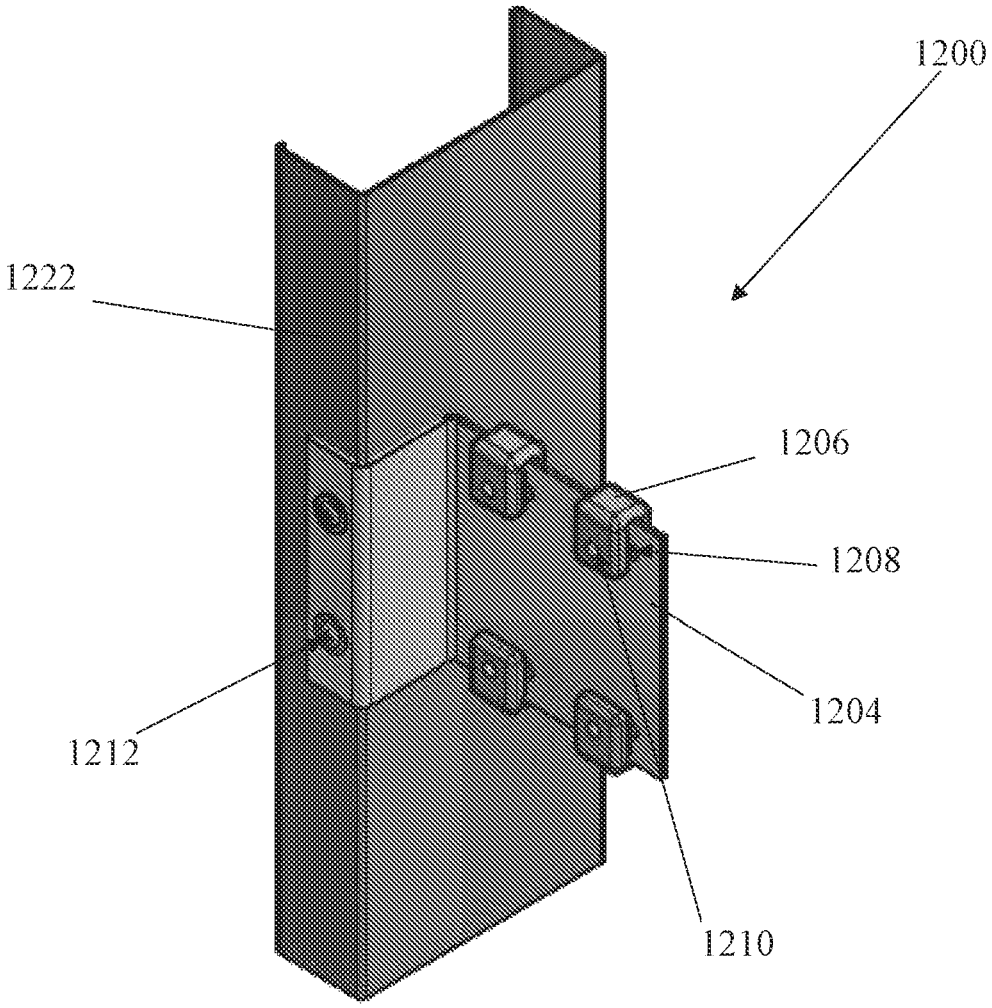
FIG. 11 is an illustration of a perspective view of one embodiment of a sound isolation assembly that is connected to a metal stud.

FIG. 11 is an illustration of a perspective view of one embodiment of a sound isolation assembly that is connected to a metal stud. As shown in FIG. 11, the sound isolation assembly 1200 may comprise backing plate 1204 and acoustic isolators 1206, which, as shown, are identical to what is shown in FIGS. 1-7. The backing plate 1204 may have slots 1208 and acoustic isolators 1206 may have holes 1210, which are configured to allow a screw or other connector to pass through. FIG. 11 shows that the backing plate 1204 may be securely fastened to a metal stud 1222, which is preferably steel in this embodiment.

Figure 12:
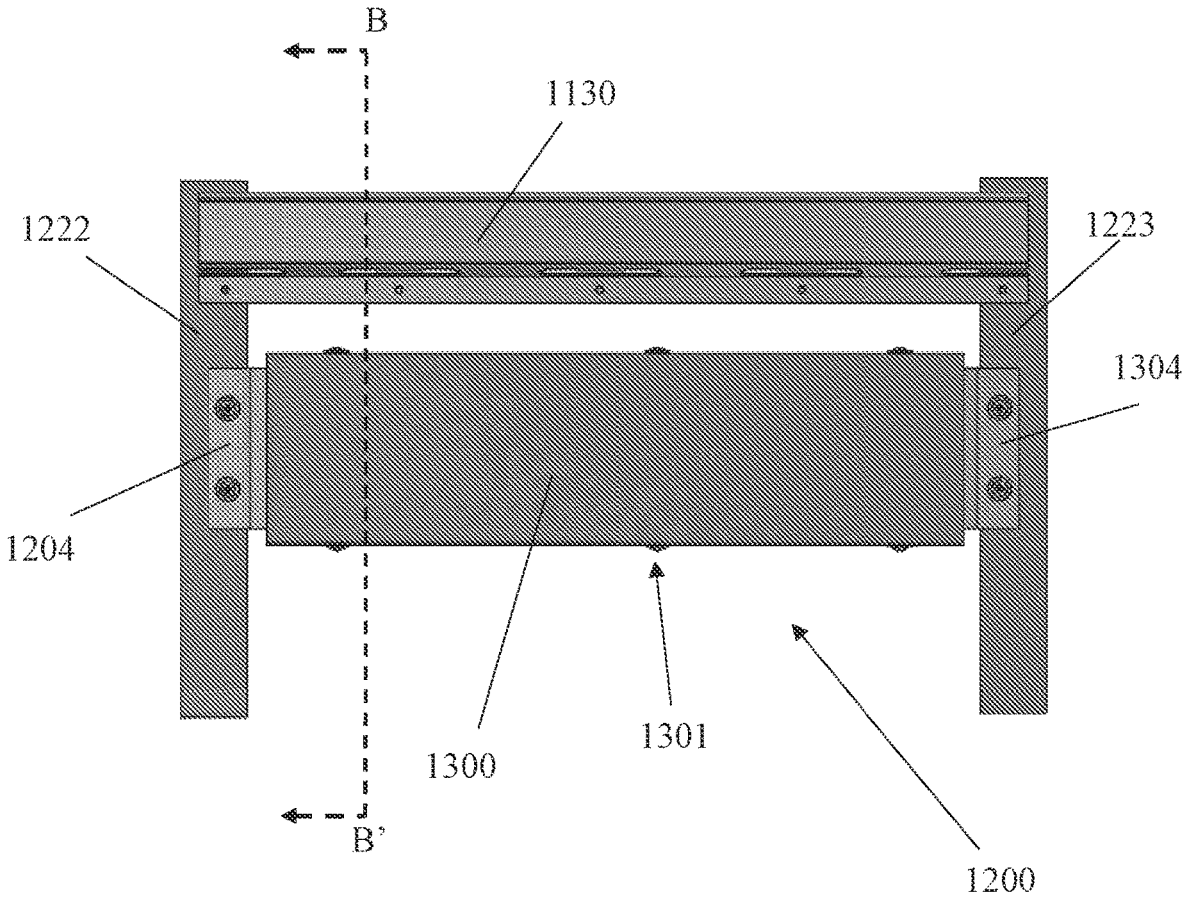
FIG. 12 is an illustration of a front view of one embodiment of a sound isolation assembly that is connected to metal studs and a metal backing block.

FIG. 12 is an illustration of a front view of one embodiment of a sound isolation assembly that is connected to metal studs and a metal backing block. As shown in FIG. 12, the assembly 1200 comprises backing block 1300 and backing plates 1204, 1304. The backing block 1300 is preferably secured to the backing plates 1204, 1304 via acoustic isolators (shown in FIG. 13). The backing block 1300 is metal, preferably steel. The backing block 1300 may be substantially hollow and formed from two C-shaped studs, or one stud and one track that are fastened together, such as with screws 1301. Any fastener may be used. Preferably, the studs 1222, 1223 are also fastened to resilient channel 1130.

Figure 13:
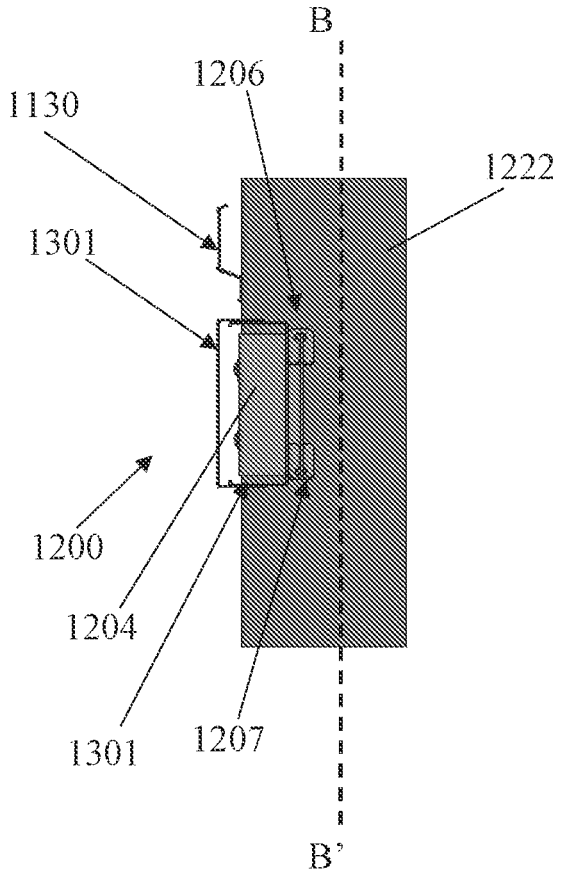
FIG. 13 is an illustration of a cross-section view of one embodiment of a sound isolation assembly that is connected to metal studs and a metal backing block.

FIG. 13 is an illustration of a cross-section view of one embodiment of a sound isolation assembly that is connected to metal studs and a metal backing block. As shown in FIG. 13, the assembly 1200 may comprise backing plates 1204, acoustic isolators 1206, 1207, and backing block 1301. As shown, the backing block 1301 is substantially hollow and is secured to the backing plates 1204 through acoustic isolators 1206, 1207. The backing block 1301 may be formed from two C-shaped or one track and one C shaped steel studs that are fastened together by fasteners 1301. As shown, the backing block 1301 may be inset within the stud 1222 and protrude approximately the same distance as the resilient channel 1130.

Figure 14:
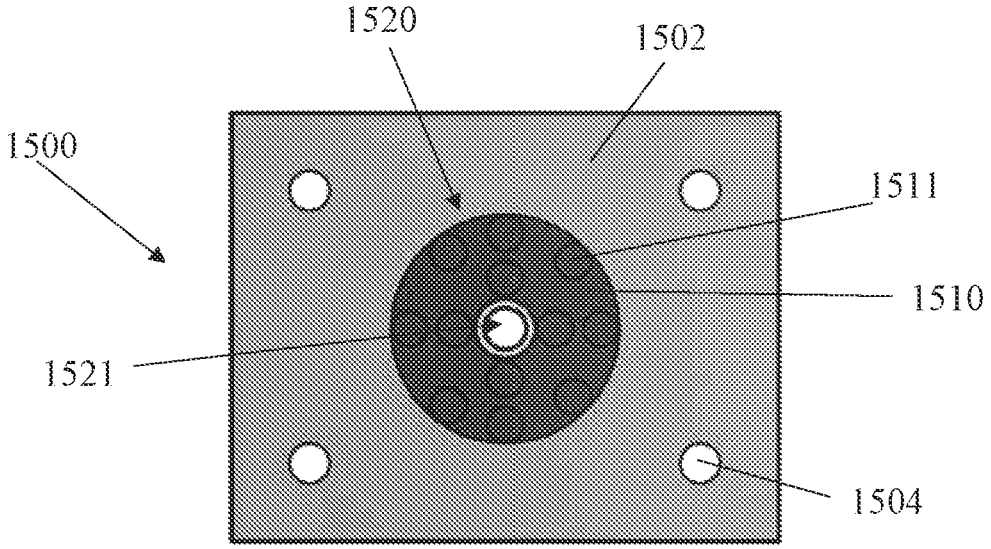
FIG. 14 is an illustration of a front view of one embodiment of a backing plate and acoustic isolator assembly.

FIG. 14 is an illustration of a front view of one embodiment of a backing plate and acoustic isolator assembly.

Figure 15:
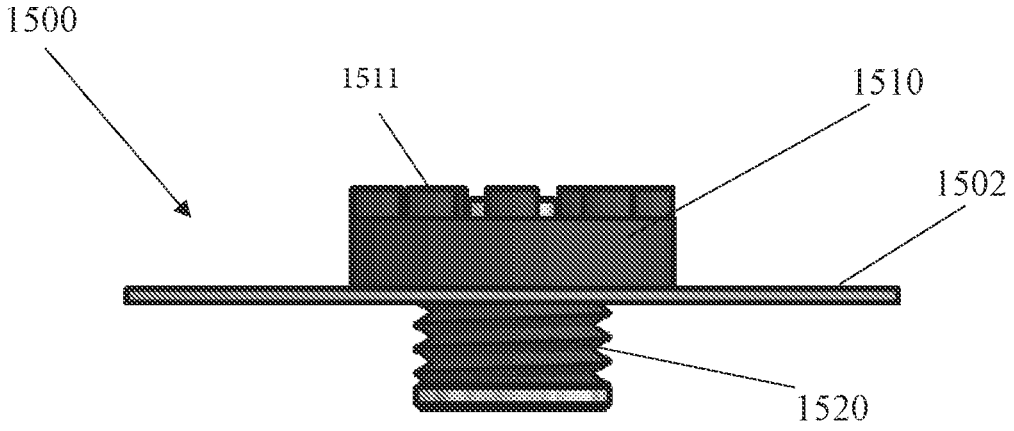
FIG. 15 is an illustration of a side view of one embodiment of a backing plate and acoustic isolator assembly.

FIG. 15 is an illustration of a side view of one embodiment of a backing plate and acoustic isolator assembly.

As shown in FIGS. 14 and 15, the backing plate and acoustic isolator assembly 1500 may comprise a backing plate 1502 and an acoustic isolator 1510. As shown, the backing plate 1502 may be an unbent rectangular metal bracket with four backing block connector holes 1504 and a hole 1520 that allows the acoustic isolator 1510 to sandwich the backing plate 1502 between a front and back portion 1520. The acoustic isolator 1510 may preferably be a viscoelastic material, such as natural or synthetic rubber. The acoustic isolator 1510 may have a plurality of nubs or protrusions 1511, which further increase sound loss capabilities. As shown, the back portion 1520 of acoustic isolator 1510 may be threaded so that it can be screwed into place in the backing plate 1502. Preferably acoustic isolator 1510 has a hole 1521, which allows the acoustic isolator assembly 1500 to be secured to a stud, preferably via a screw, such as shown via screw 2099 in FIG. 19.

Figure 16:
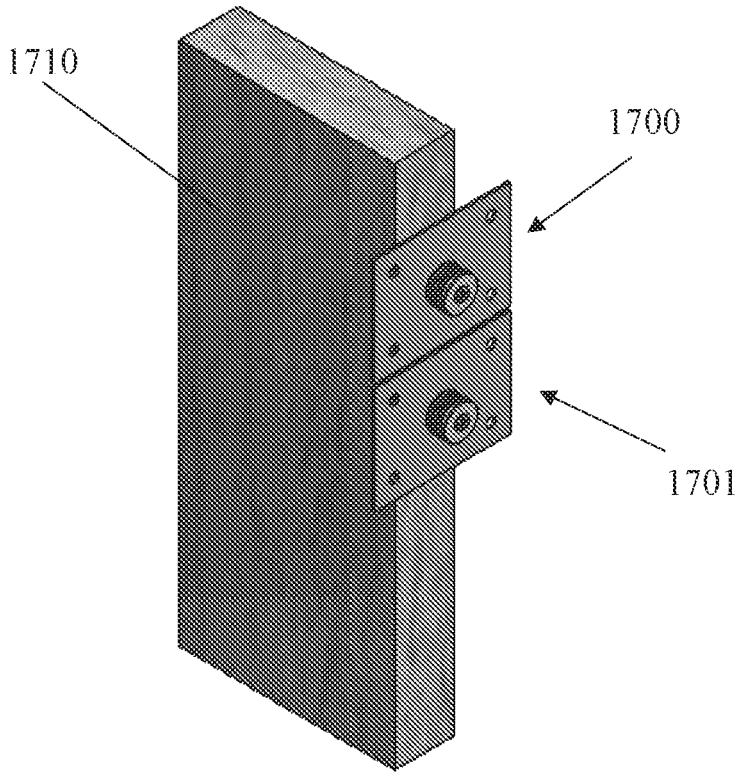
FIG. 16 is an illustration of a perspective view of one embodiment of a backing plate and acoustic isolator assembly attached to a stud.

FIG. 16 is an illustration of a perspective view of one embodiment of two backing plate and acoustic isolator assemblies 1700, 1701 attached to a stud 1710.

Figure 17:
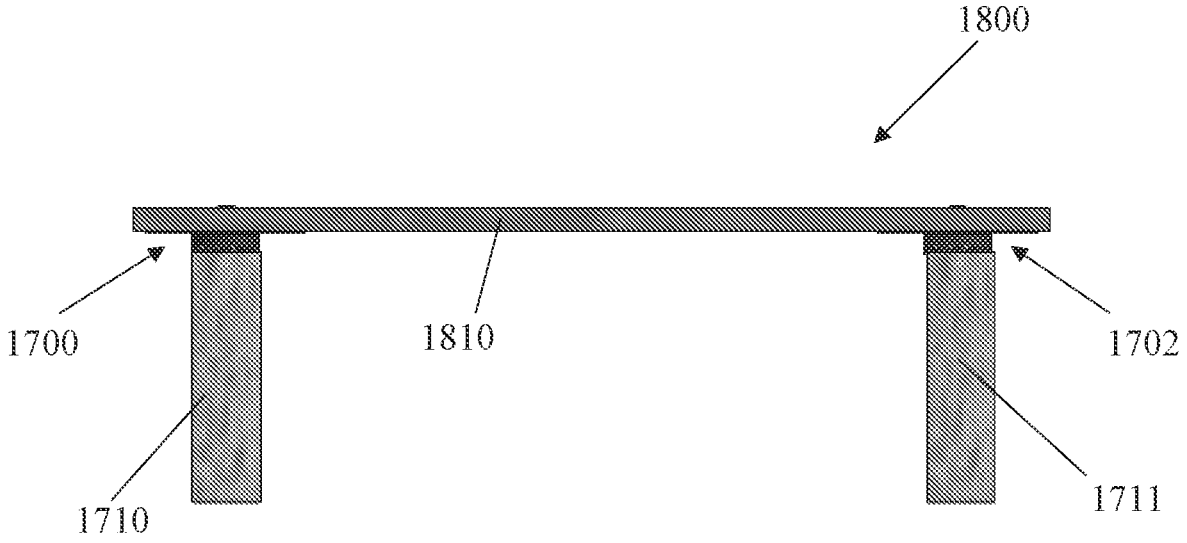
FIG. 17 is an illustration of a top view of one embodiment of a sound isolation assembly.

FIG. 17 is an illustration of a top view of one embodiment of a sound isolation assembly. FIG. 17 shows that the sound isolation assembly 1800 may comprise a backing block 1810 and backing plate and acoustic isolator assemblies 1700, 1702, which are attached to studs 1710 and 1711. As shown, the studs 1710, 1711 and backing block 1810 may preferably be solid wood, but plywood, OSB, metal, and the like may be used, so long as the heavy load to be secured to the backing board can be supported by the backing board.

Figure 18:
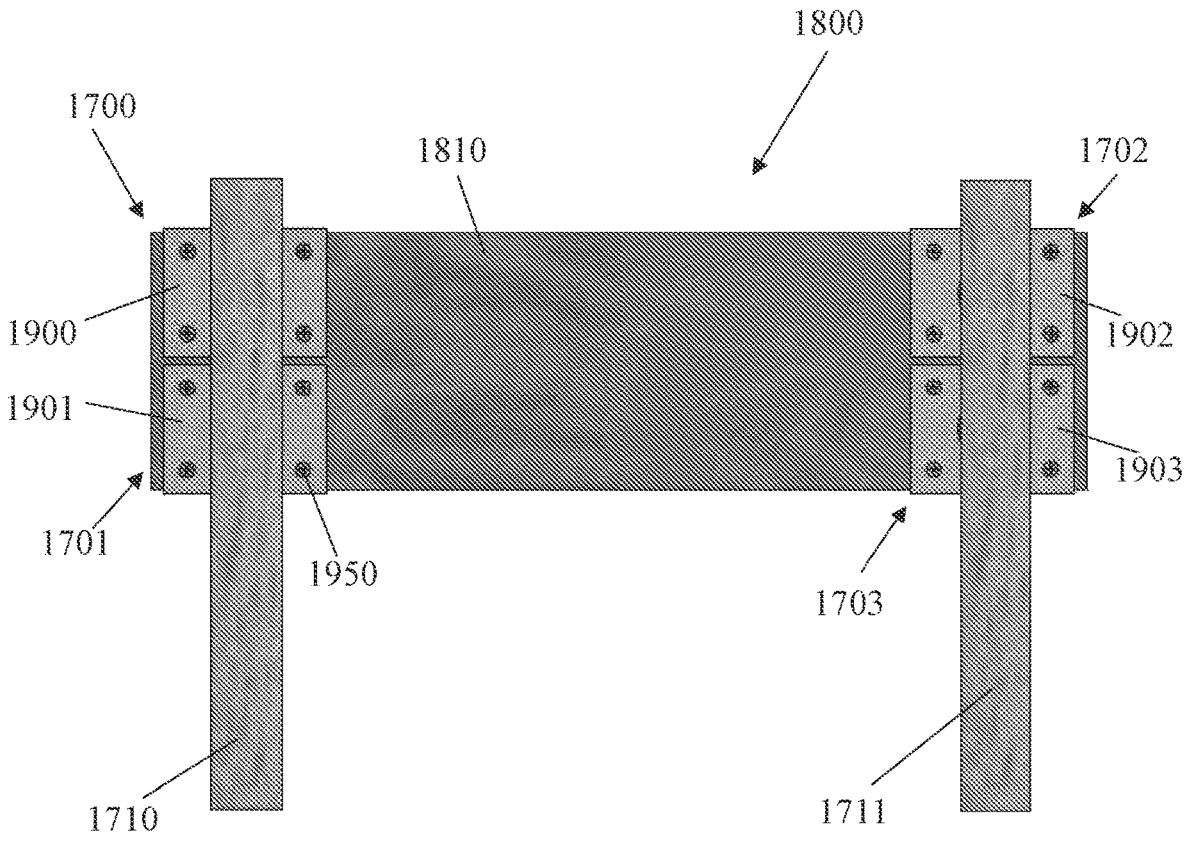
FIG. 18 is an illustration of a rear view of one embodiment of a sound isolation assembly.

FIG. 18 is an illustration of a rear view of one embodiment of a sound isolation assembly. FIG. 18 shows that the sound isolation assembly 1800 may comprise a backing block 1810 and backing plate and acoustic isolator assemblies 1700, 1702, which are attached to studs 1710 and 1711. The backing plates 1900, 1901, 1902, 1903 may be secured or fastened to backing block 1810 via screws, such as screw 1950. Any fastening mechanism may be used, such as a bolt, nail, adhesive, and the like.

Figure 19:
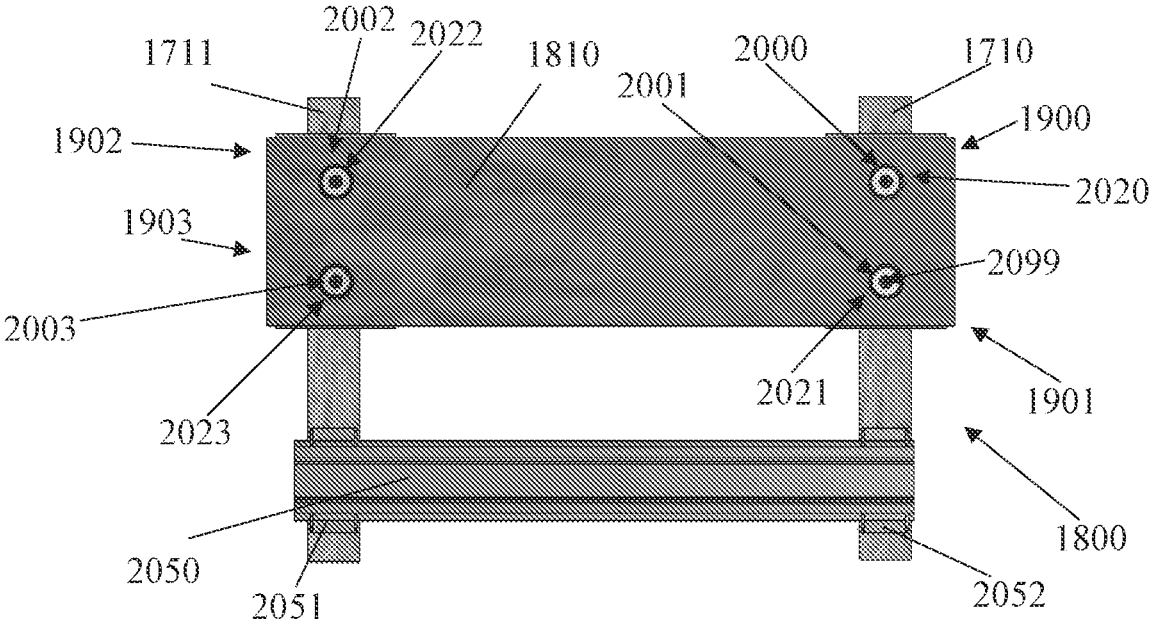
FIG. 19 is an illustration of a front view of one embodiment of a sound isolation assembly.

FIG. 19 is an illustration of a front view of one embodiment of a sound isolation assembly. The assembly 1800 may comprise backing block 1810, backing plates 1900, 1901, 1902, 1903, and acoustic isolators 2000, 2001, 2002, 2003. When the backing plates 1900, 1901, 1902, 1903 are secured or fastened to the rear of the backing block 1810, the rear end of the acoustic isolators 2000, 2001, 2002, 2003 may be matingly inset into holes 2020, 2021, 2022, 2023. The screws 2099 preferably connect the assembly 1800 to the suds 1710, 1711. Preferably the studs 1710, 1711 are also connected by a resilient channel 2050, which may be held in place on each stud 1710, 1711 via clips 2051, 2052.

Figure 20:
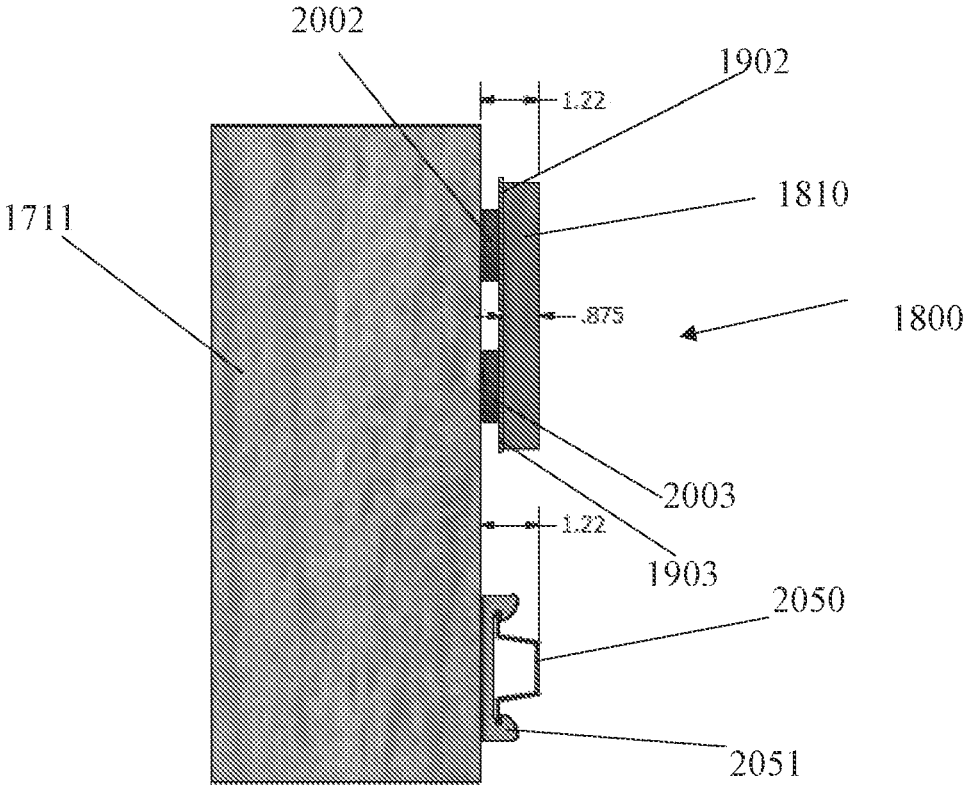
FIG. 20 is an illustration of a side view of one embodiment of a sound isolation assembly.

FIG. 20 is an illustration of a side view of one embodiment of a sound isolation assembly. The assembly 1800 may comprise backing block 1810, backing plates 1902, 1903, and acoustic isolators 2002, 2003. As shown, the backing plates 1902, 1903 are secured or fastened to the rear of the backing block 1810. The acoustic isolators 2002, 2003 are flush with and connected to the stud 1711. Preferably the stud 1711 is also secured to clip 2051, which holds in place resilient channel 2050. As shown, the outer end of the resilient channel 2050 preferably protrudes away from the stud 1711 the same distance as the outer face of backing block 1810. In this manner, the backing block 1810 and the resilient channel 2050 may evenly engage with a wall, such as a gypsum board or sheet rock.

The backing block 1810 and studs 1711, 1710 may be solid wood, plywood, OSB, metal, alloys, and the like.

Figure 21:
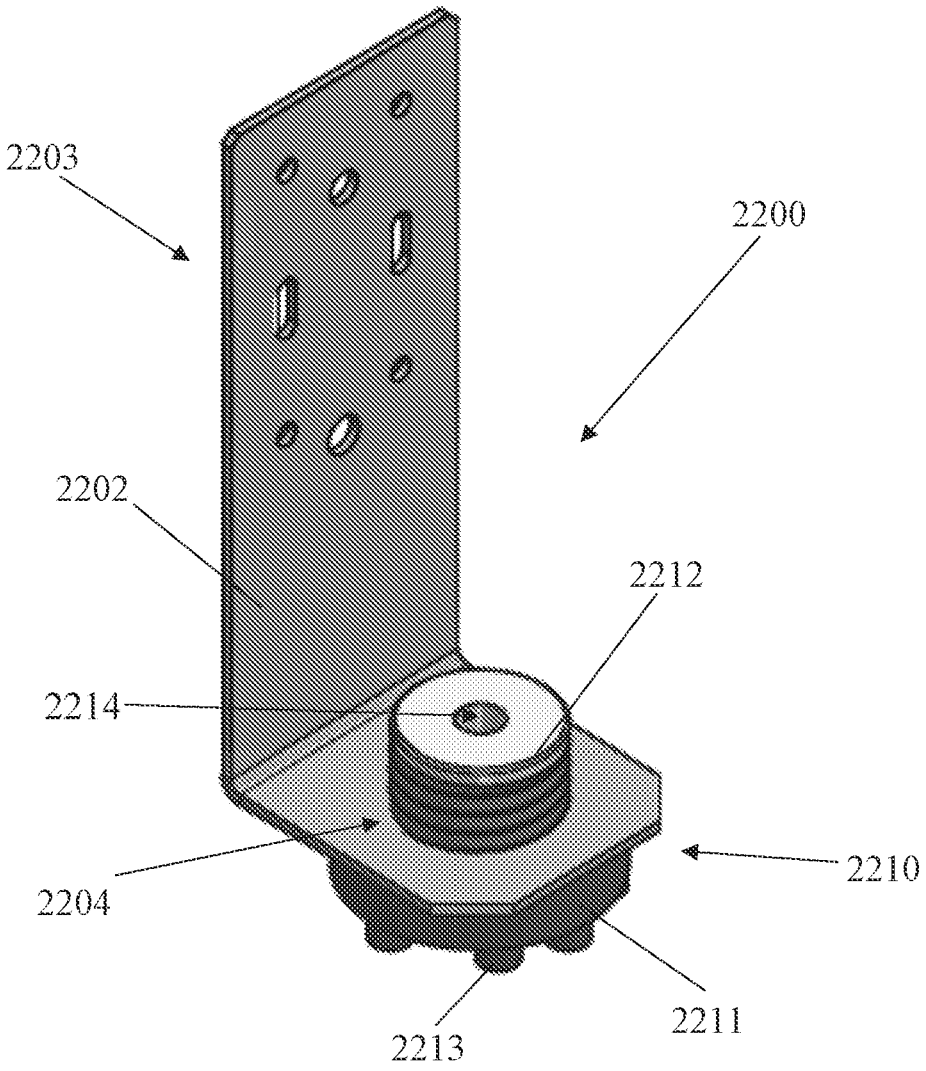
FIG. 21 is an illustration of a perspective view of one embodiment of a backing plate and acoustic isolator assembly.

FIG. 21 is an illustration of a perspective view of one embodiment of a backing plate and acoustic isolator assembly. As shown in FIG. 21, the backing plate and acoustic isolator assembly 2200 may comprise a backing plate 2202 and acoustic isolator 2210. As shown, the backing plate 2202 may be a rectangular metal bracket with approximately a 90 Degree bend with a plurality of block connector holes 2203 and a hole 2204 that allows the acoustic isolator 2210 to sandwich the backing plate 2202 between a front portion 2211 and back portion 2212. The acoustic isolator 2210 may preferably be a viscoelastic material, such as natural or synthetic rubber. The acoustic isolator 2210 may have a plurality of nubs or protrusions 2213, which further increase sound loss capabilities. Preferably acoustic isolator 2210 has a hole 2214, which allows the acoustic isolator assembly 2200 to be secured to a stud, preferably via a screw. The backing plates may preferably be steel or another strong metal or alloy.

Figure 22:
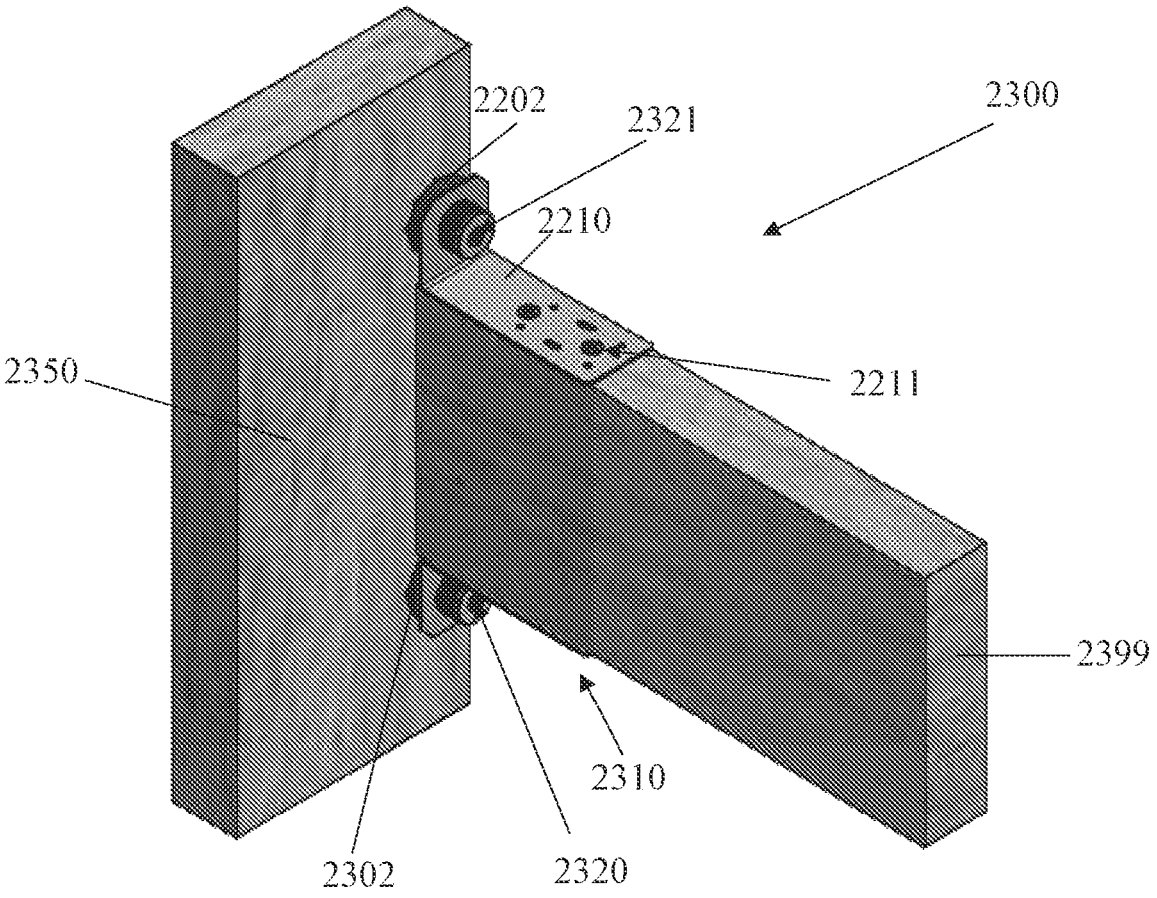
FIG. 22 is an illustration of a rear perspective view of another embodiment of a sound isolation assembly.

FIG. 22 is an illustration of a rear perspective view of another embodiment of a sound isolation assembly. As shown, the sound isolation assembly 2300 may comprise backing block 2399, backing plates 2210, 2310, and acoustic isolators 2202, 2302. As shown backing plate 2210 may be connected to and/or securely fastened to the backing block 2399 via screws 2211. Other fasteners may be used, such as bolts, nails, or adhesive. The sound isolation assembly 2300 may be secured to a stud 2350 via screws 2320, 2321. Other fasteners may be used, such as bolts, nails, or adhesive. As shown, the acoustic isolators 2202, 2302 are between the backing plates 2210, 2310 and the stud 2350, and provide significant acoustic dampening. FIG. 22 shows that the width of the backing plates 2210, 2310 may be the same as the width of the backing block 2399. However, the backing block may be wider than the backing plates. FIG. 22 shows that front of the backing block 2399 may be flush with the front of the stud 2350. However, the backing block may be offset behind or in front of the front of the studs, depending on the width of the backing block.

Figure 23:
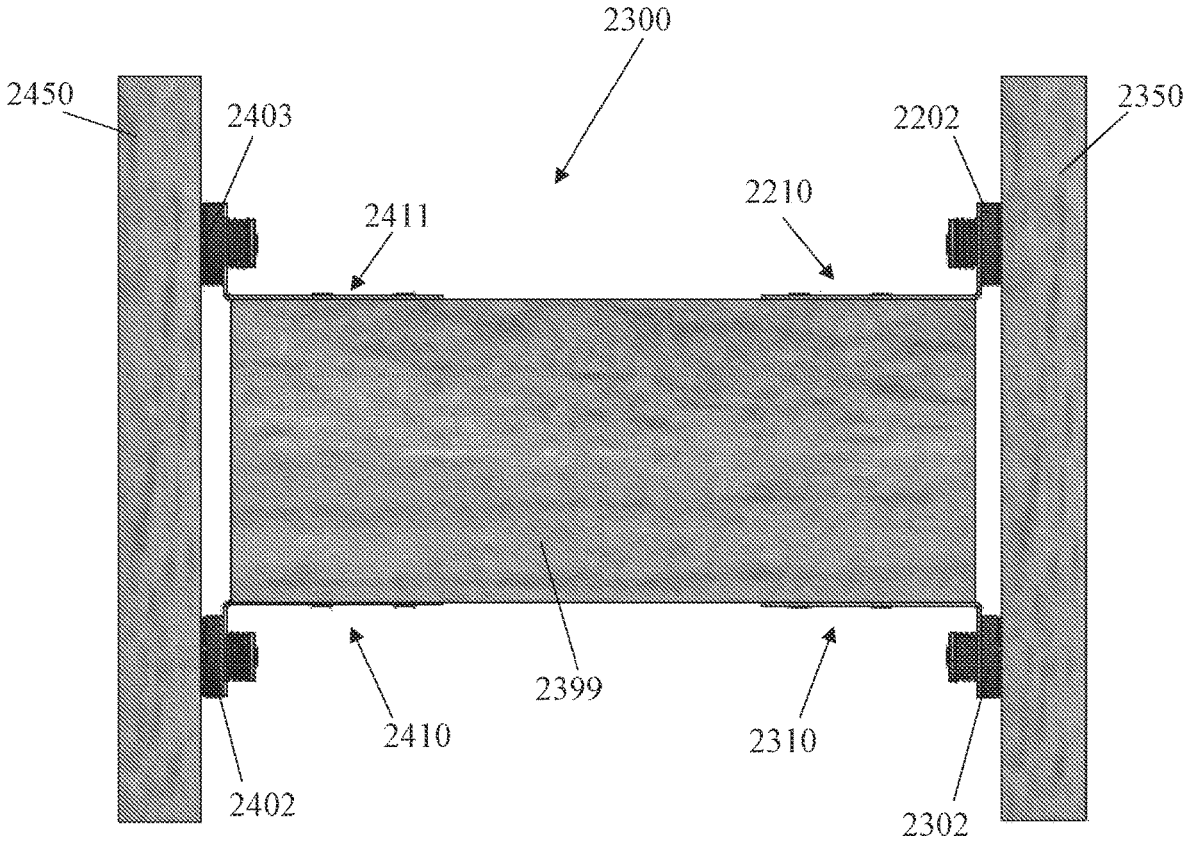
FIG. 23 is an illustration of a front view of another embodiment of a sound isolation assembly.

FIG. 23 is an illustration of a front view of another embodiment of a sound isolation assembly. As shown, the sound isolation assembly 2300 may comprise backing block 2399, backing plates 2210, 2310, 2410, 2411 and acoustic isolators 2202, 2302, 2402, 2403. All four backing plates 2210, 2310, 2410, 2411 may be connected to and/or securely fastened to the backing block 2399. The sound isolation assembly 2300 may be secured to studs 2350, 2450. As shown, the acoustic isolators 2202, 2302, 2402, 2403 are between the backing plates 2210, 2310, 2410, 2411 and the studs 2350, 2450 and provide significant acoustic dampening.

Figure 24:
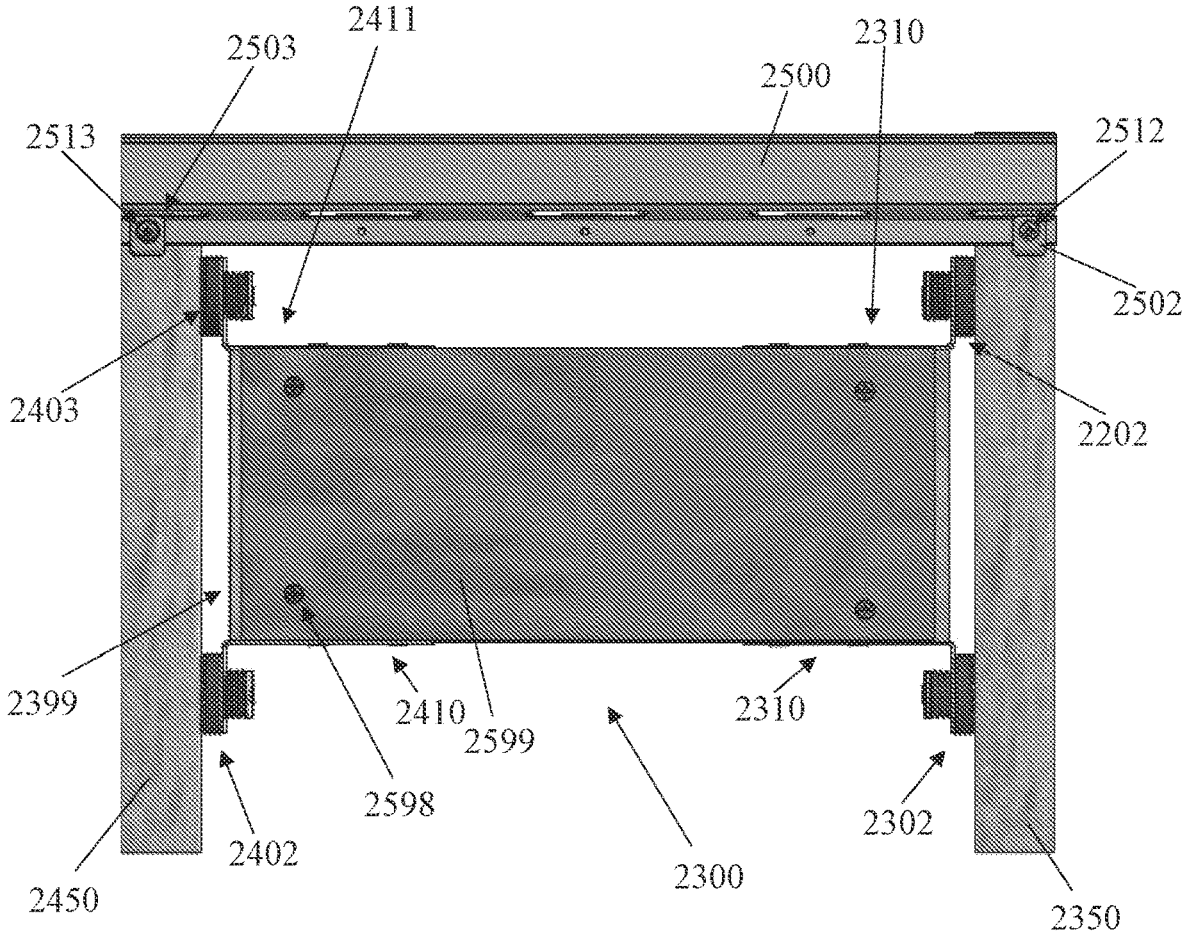
FIG. 24 is an illustration of a front view of another embodiment of a sound isolation assembly.

FIG. 24 is an illustration of a front view of another embodiment of a sound isolation assembly. FIG. 24 shows the same sound isolation assembly 2300, but the studs 2350, 2450 are connected to a resilient channel 2500. The resilient channel 2500 may be secured to the studs 2350, 2450 through acoustic isolators 2502, 2503 by screws 2512, 2513. Additionally, backing block extension block 2599 is shown as secured to backing block 2399 via screws 2598.

Figure 25:
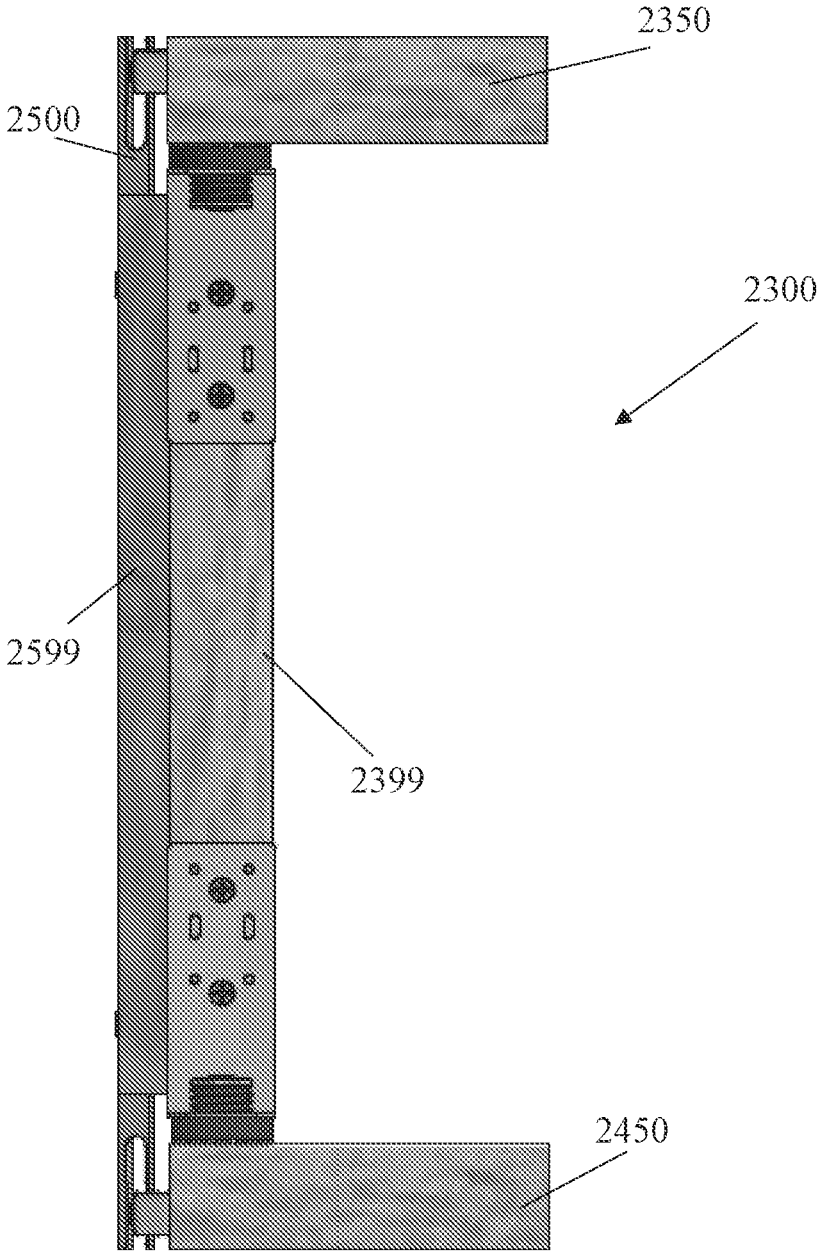
FIG. 25 is an illustration of a bottom view of another embodiment of a sound isolation assembly.

FIG. 25 is an illustration of a bottom view of another embodiment of a sound isolation assembly. FIG. 25 shows that the backing block extension block 2599 may be secured to backing block 2399 and be part of the sound isolation assembly 2300. In this manner, the front of the backing block extension block 2599 is even with the front of the resilient channel 2500, such that they evenly engage with a gypsum wall two which they are connected.

The backing block 2399, backing block extension block 2599, and studs 2350, 2450 may be solid wood, plywood, OSB, metal, alloys, and the like.

Figure 26:
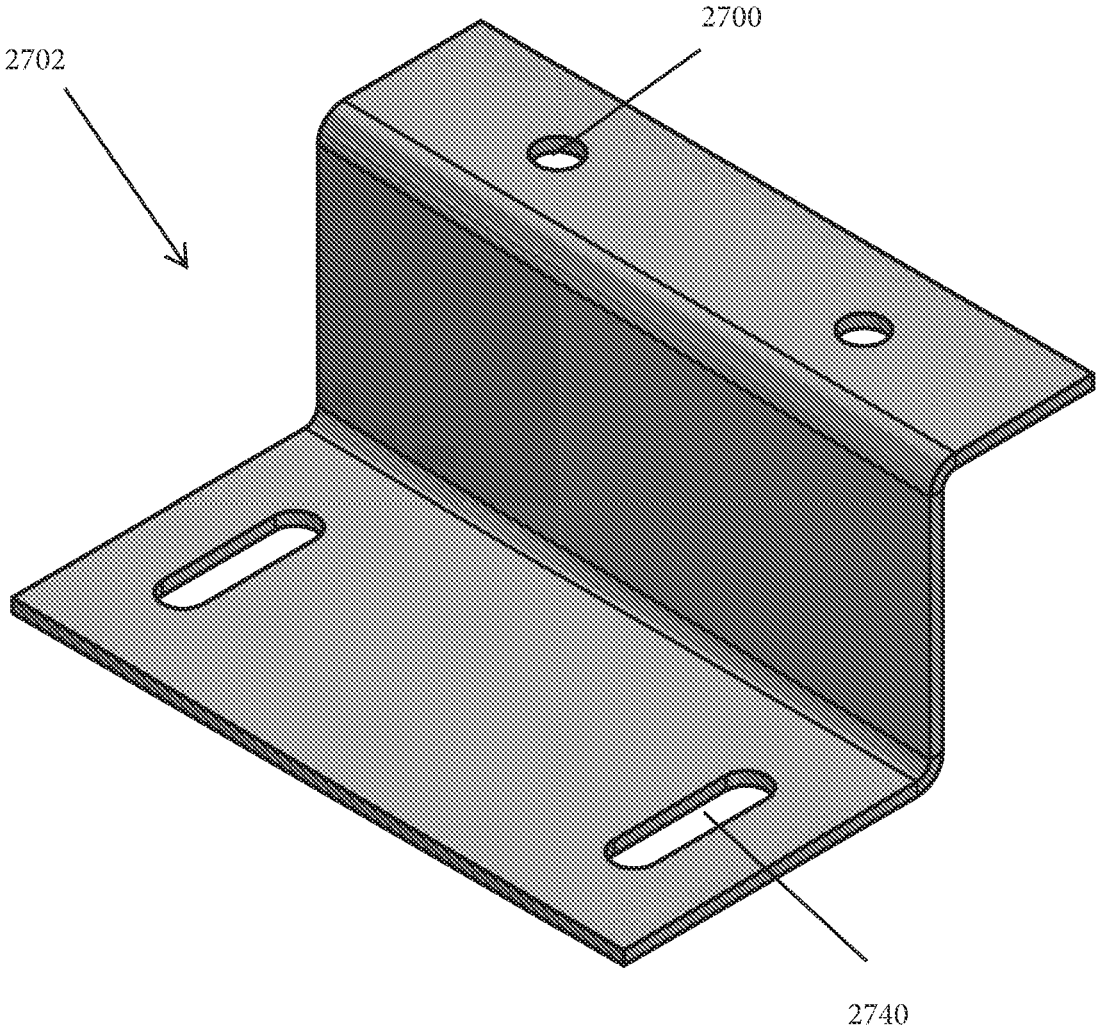
FIG. 26 is a perspective view of one embodiment of a backing plate.

FIG. 26 is a perspective view of one embodiment of a backing plate. As shown in FIG. 26 backing plate 2702 may be a lazy Z-shape with slots 2740, stud screw holes 2700. The embodiment shown in FIG. 26 only has two slots 2740 and is configured to be used with lighter loads (approximately 20 to 100 pounds per backing plate) than the backing plate shown in FIG. 7.

Figure 27:
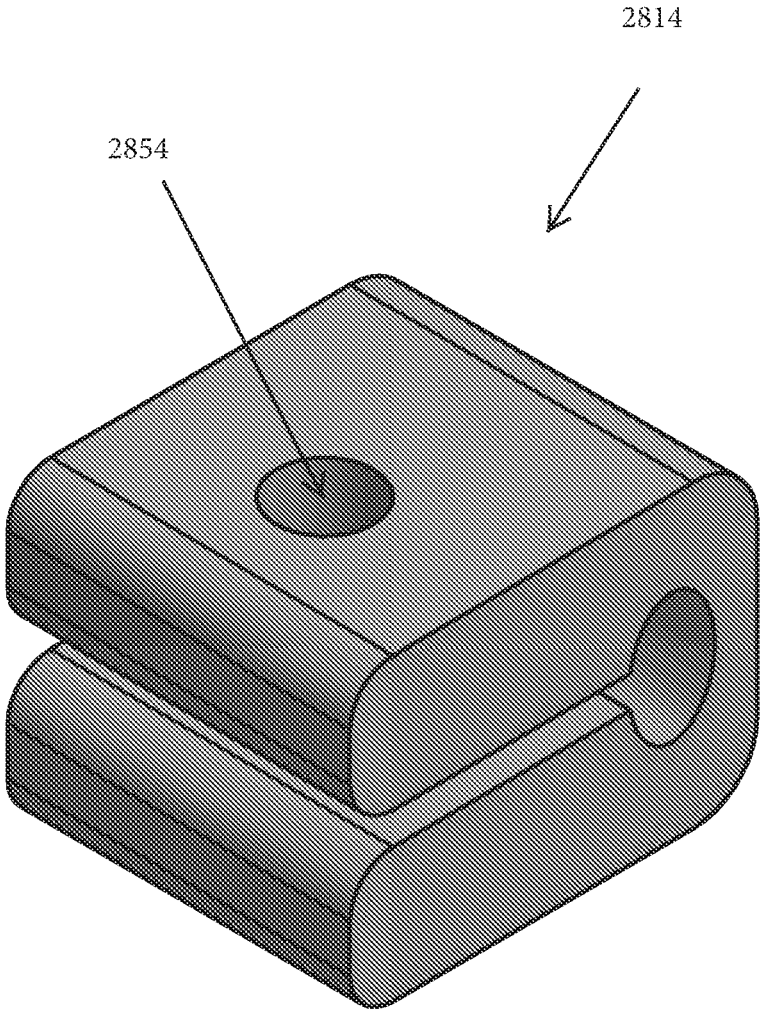
FIG. 27 is a perspective view of one embodiment of an acoustic isolator.

FIG. 27 is a perspective view of one embodiment of an acoustic isolator. As shown in FIG. 27, the acoustic isolator 2814 may have a hole 2854. In this embodiment, the acoustic isolator 2814 is substantially a U-shaped cube with flat sides and rounded ends.

Figure 28:
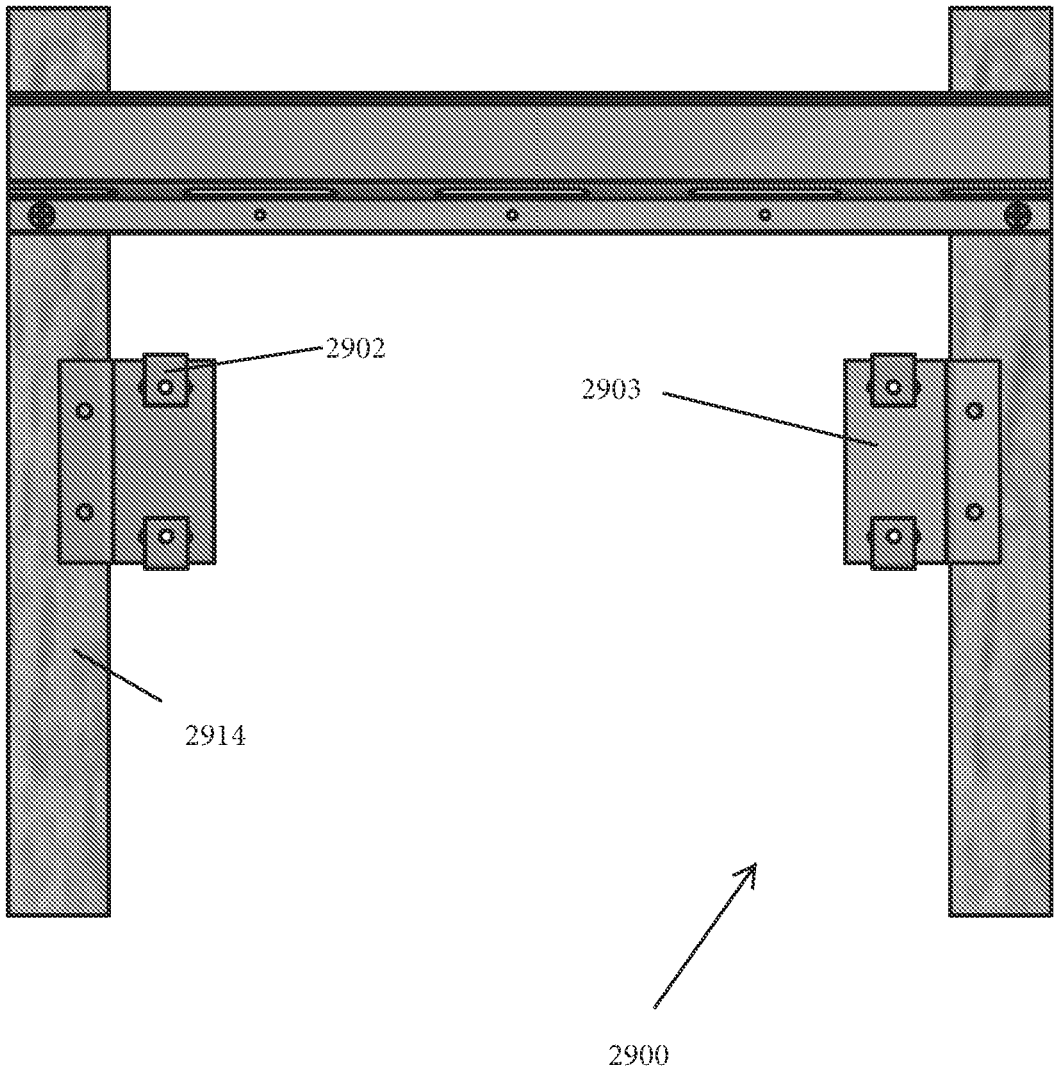
FIG. 28 is an illustration of a front view of one embodiment of a sound isolation assembly.

FIG. 28 is an illustration of a front view of one embodiment of a sound isolation assembly. As shown in FIG. 1, the assembly 2900 may comprise backing plates 2903 and acoustic isolators 2902. The backing plates 2903 are configured to matingly engage with studs 2914. In this embodiment, the backing plates 2903 only have two slots and are used for lighter loads.

Figure 29:
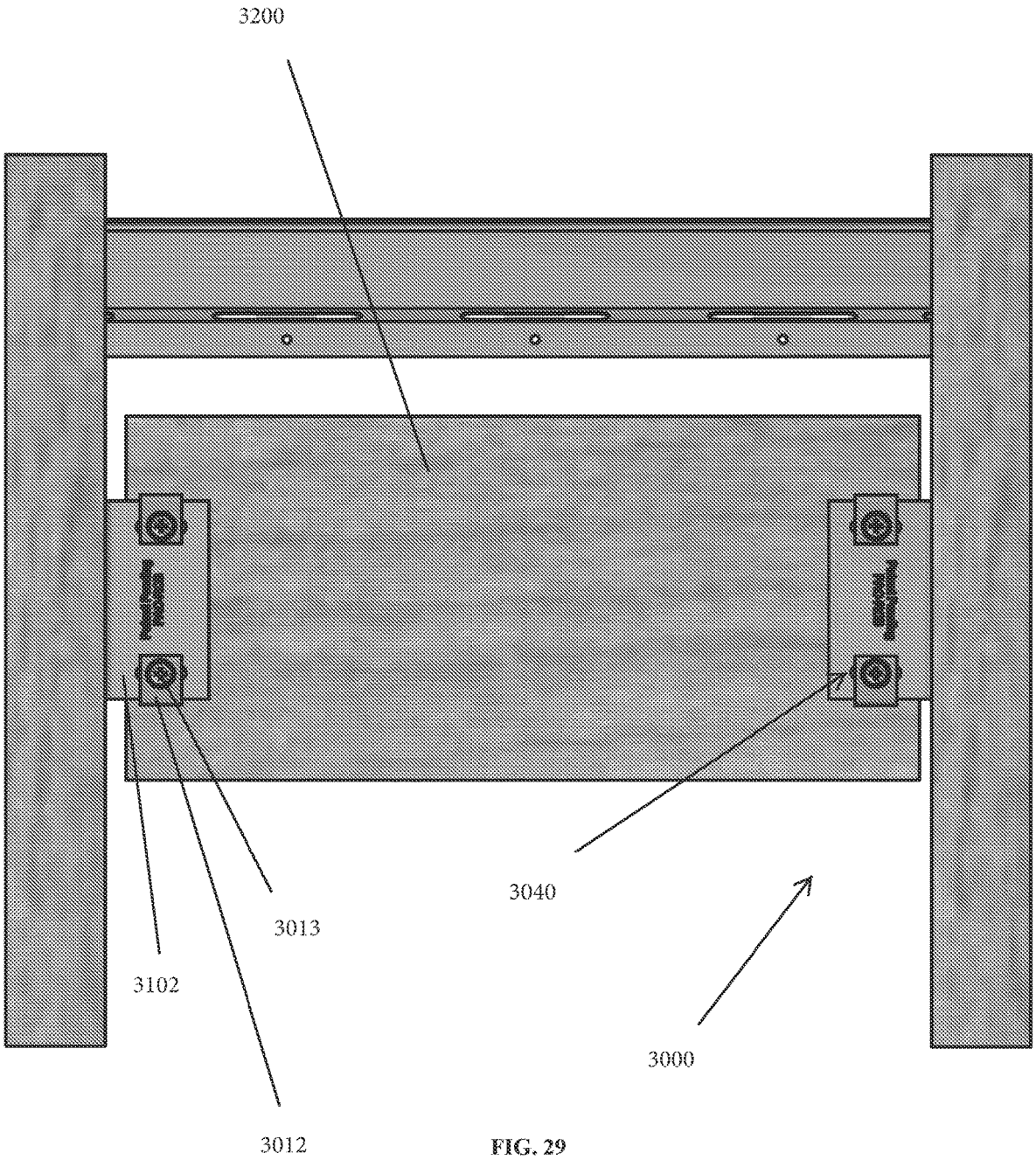
FIG. 29 is a rear view of one embodiment of a sound isolation assembly.

FIG. 29 is a rear view of one embodiment of a sound isolation assembly. As shown in FIG. 29, the assembly 3000 may comprise two backing plates 1302, four acoustic isolators 3012 (two for each backing plate), and backing block 3200. FIG. 29 also shows that screws 3013 pass through holes 3040 to securely fasten the isolators 3012 and the backing plates 3102 to the backing block 3200.

Figure 30:
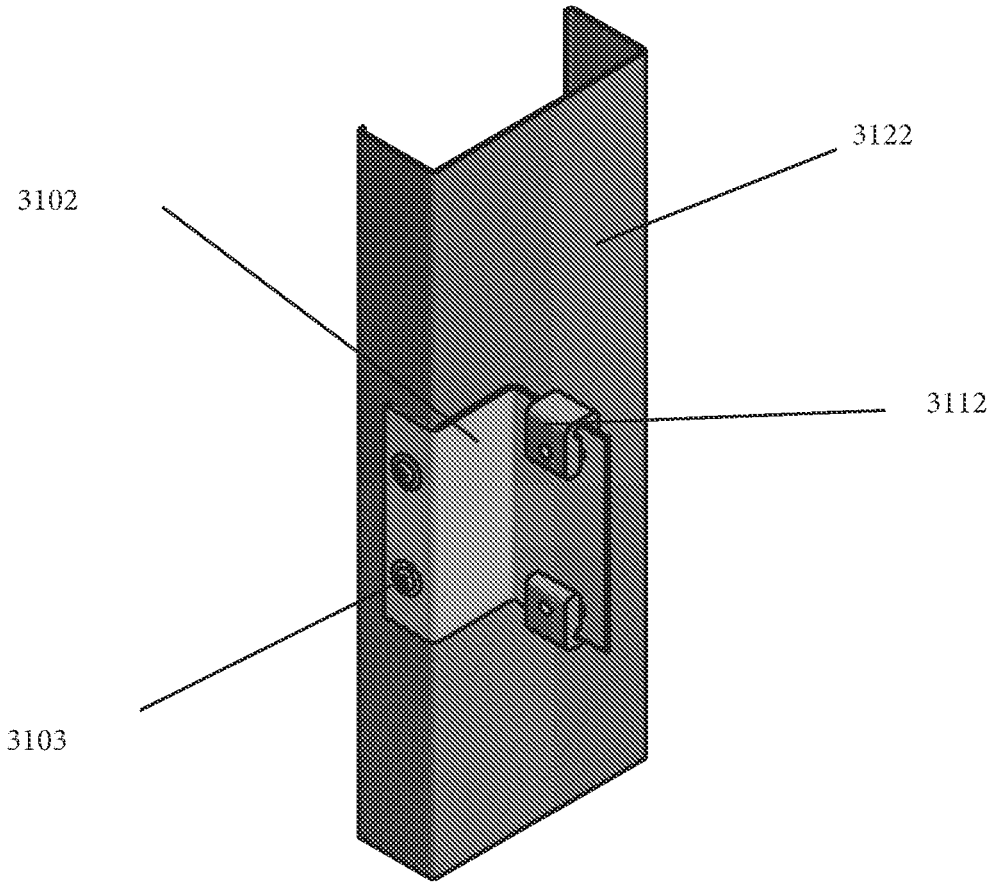
FIG. 30 is a perspective view of one embodiment of a backing plate and acoustic isolator assembly attached to a metal stud.

FIG. 30 is a perspective view of one embodiment of a backing plate and acoustic isolator assembly attached to a metal stud. FIG. 30 shows the backing plat 3012 and acoustic isolator 3112 assembly secured to a metal stud 3122 via screws 3103.

Figure 31:
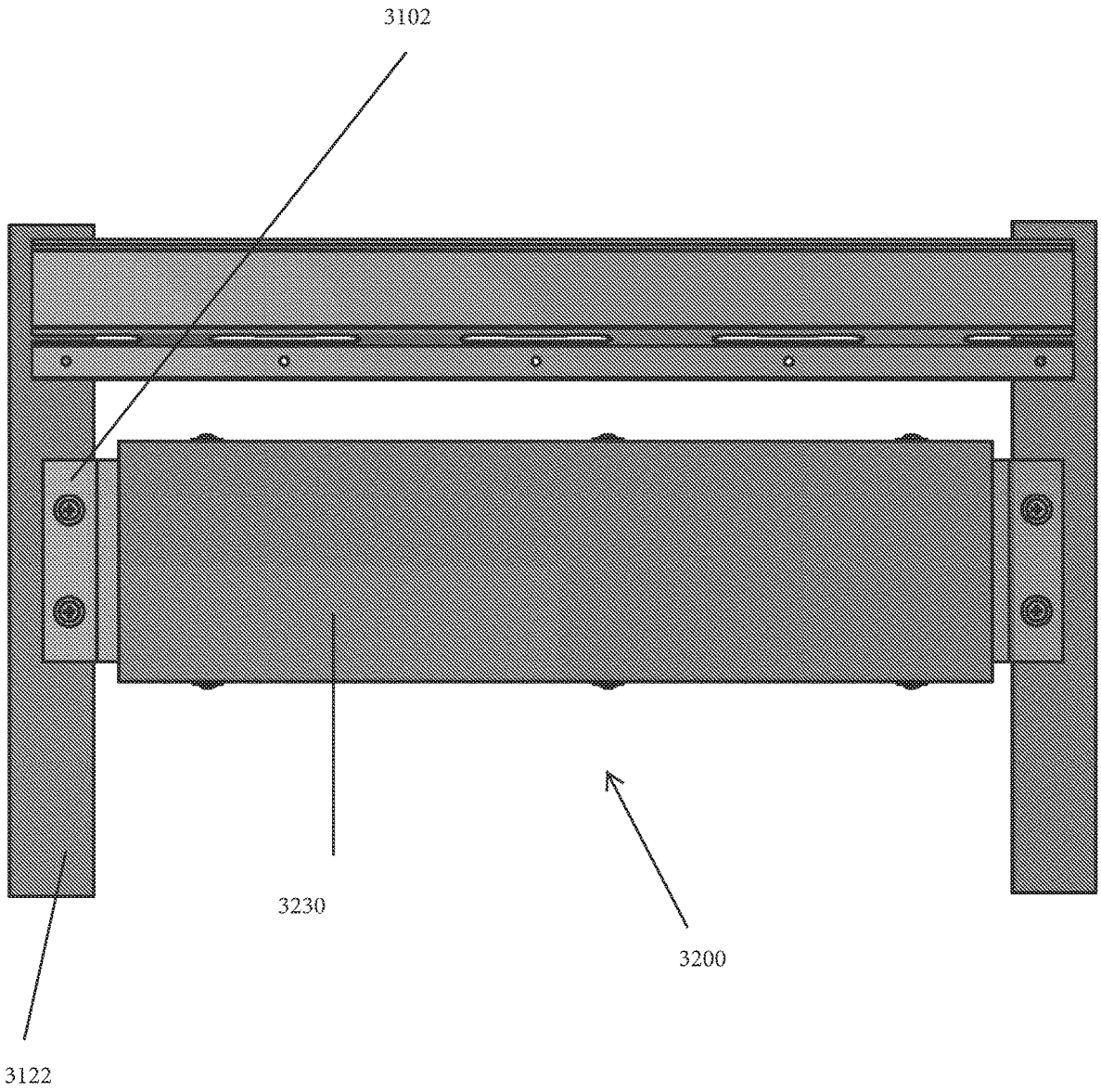
FIG. 31 is a front view of one embodiment of a sound isolation assembly attached to metal studs and with a metal backing block.

FIG. 31 is a front view of one embodiment of a sound isolation assembly attached to metal studs and with a metal backing block. FIG. 31 shows sound isolation assembly 3200 may comprise metal backing 3230 and backing plates 3102, which are secured to studs 3122.

Unless otherwise stated, all measurements, values, ratings, positions, magnitudes, sizes, locations, and other specifications that are set forth in this specification, including in the claims that follow, are approximate, not exact. They are intended to have a reasonable range that is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description. These embodiments are capable of modifications in various obvious aspects, all without departing from the spirit and scope of protection. Accordingly, the detailed description is to be regarded as illustrative in nature and not restrictive. Also, although not explicitly recited, one or more embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing that has been stated or illustrated is intended or should be interpreted to cause a dedication of any component, step, feature, object, benefit, advantage, or equivalent, to the public, regardless of whether it is or is not recited in the claims.

What is claimed is:

1. A sound isolation assembly comprising:

one or more backing plates;

one or more acoustic isolators; and a backing block;

wherein said one or more acoustic isolators are configured to be secured between said one or more backing plates and said backing block when said one or more backing plates are fastened to said backing block;

wherein said one or more backing plates are lazy Z-shaped;

wherein when said one or more backing plates are fastened to said backing block, said one or more backing plates are substantially prevented by said one or more acoustic isolators from being in direct contact with said backing block; and wherein said one or more acoustic isolators are configured to be fastened to one or more studs.

2. The sound isolation assembly of claim 1, wherein said one or more studs are configured to be fastened to a resilient channel; and wherein said resilient channel protrudes away from said one or more studs at a same distance as said backing block.

3. The sound isolation assembly of claim 1, wherein said backing block is made from a material from the group of materials consisting of one or more of: solid wood; plywood; oriented strand board; metal; and combinations thereof.

4. The sound isolation assembly of claim 1, wherein said one or more studs are made from a material from the group of materials consisting of one or more of: solid wood; plywood; oriented strand board; metal; and combinations thereof.

5. The sound isolation assembly of claim 1, wherein said backing block is configured to be fastened to and support loads in excess of twenty pounds in weight.

6. The sound isolation assembly of claim 1, wherein when said sound isolation assembly is installed in a wall that is supporting a heavy load, said sound isolation assembly raises the Sound Transmission Class rating of said wall.

7. A sound isolation assembly comprising:

one or more backing plates;

one or more acoustic isolators; and a backing block;

wherein said one or more acoustic isolators are configured to be secured between said one or more backing plates and said backing block when said one or more backing plates are fastened to said backing block;

wherein when said one or more backing plates are fastened to said backing block, said one or more backing plates are substantially prevented by said one or more acoustic isolators from being in direct contact with said backing block;

wherein said one or more backing plates are lazy Z-shaped;

wherein said one or more acoustic isolators are configured to be fastened to one or more studs;

wherein said one or more studs are configured to be fastened to a resilient channel;

wherein said resilient channel protrudes away from said one or more studs at a same distance as said backing block; and wherein when said sound isolation assembly is installed in a wall that is supporting a heavy load, said sound isolation assembly raises the Sound Transmission Class rating of said wall.

8. The sound isolation assembly of claim 7, wherein said backing block is made from a material from the group of materials consisting of one or more of: solid wood; plywood; oriented strand board; metal; and combinations thereof.

9. The sound isolation assembly of claim 7, wherein said one or more studs are made from a material from the group of materials consisting of one or more of: solid wood; plywood; oriented strand board; metal; and combinations thereof.

10. The sound isolation assembly of claim 7, wherein said backing block is configured to be fastened to and support loads in excess of twenty pounds in weight.

11. A sound isolation assembly comprising:

one or more backing plates;

one or more acoustic isolators; and a backing block;

wherein said one or more acoustic isolators are configured to be secured between said one or more backing plates and said backing block when said one or more backing plates are fastened to said backing block;

wherein when said one or more backing plates are fastened to said backing block, said one or more backing plates are substantially prevented by said one or more acoustic isolators from being in direct contact with said backing block;

wherein said one or more acoustic isolators are configured to be fastened to one or more studs;

wherein said one or more studs are configured to be fastened to a resilient channel;

wherein said resilient channel protrudes away from said one or more studs at a same distance as said backing block;

wherein when said sound isolation assembly is installed in a wall that is supporting a heavy load, said sound isolation assembly raises the Sound Transmission Class rating of said wall;

wherein said one or more backing plates are lazy Z-shaped;

wherein said backing block is made from a material from the group of materials consisting of one or more of: solid wood; plywood; oriented strand board; metal; and combinations thereof; and wherein said backing block is configured to be fastened to and support loads in excess of twenty pounds in weight.

* * * * *